US010792520B2

(12) United States Patent
Boraas et al.

(10) Patent No.: US 10,792,520 B2
(45) Date of Patent: Oct. 6, 2020

(54) PERSONAL DESCENT SYSTEM

(71) Applicant: D B Industries, LLC, Red Wing, MN (US)

(72) Inventors: Michael A. Boraas, Zumbrota, MN (US); Andrew K. Thomforde, Goodhue, MN (US); Treyben P. Kehren, Goodhue, MN (US)

(73) Assignee: D B INDUSTRIES, LLC, Maplewood, MN (US)

( * ) Notice: Subject to any disclaimer, the term of this patent is extended or adjusted under 35 U.S.C. 154(b) by 0 days.

(21) Appl. No.: 14/838,879

(22) Filed: Aug. 28, 2015

(65) Prior Publication Data

US 2016/0074681 A1 Mar. 17, 2016

Related U.S. Application Data

(60) Provisional application No. 62/049,629, filed on Sep. 12, 2014.

(51) Int. Cl.
*A62B 1/08* (2006.01)
*A62B 1/14* (2006.01)
(Continued)

(52) U.S. Cl.
CPC ..... *A62B 1/08* (2013.01); *A62B 1/10* (2013.01); *A62B 1/14* (2013.01); *A62B 1/16* (2013.01);
(Continued)

(58) Field of Classification Search
CPC .... A62B 1/08; A62B 1/10; A62B 1/14; A62B 1/16; A62B 35/0037; A62B 35/0093
See application file for complete search history.

(56) References Cited

U.S. PATENT DOCUMENTS 191,118 A * 5/1877 Dartt ..... A62B 1/10 182/240
456,281 A 7/1891 Athey
(Continued)

FOREIGN PATENT DOCUMENTS

AU 2011204950 B2 8/2011
CA 2080715 4/1994
(Continued)

OTHER PUBLICATIONS

International Search Report for PCT/US2015/048907 dated Apr. 25, 2016, 7 pages.

*Primary Examiner* — Katherine W Mitchell
*Assistant Examiner* — Candace L Bradford

(57) ABSTRACT

A personal descent system is provided. The personal descent system includes a support structure coupling assembly and a control descent device. The support structure coupling assembly is configured and arranged to be coupled to a descent lifeline. The support structure coupling assembly includes an adaptor connection member. The adaptor connection member is configured and arranged to couple different types of lifelines and lanyards to the support structure coupling assembly. The control descent device is selectively coupled to the support structure coupling assembly. The control descent device is configured and arranged to be coupled to a safety harness donned by a user. The control descent device is further configured to detach from the support structure coupling assembly during a descent operation while controlling a payout of the descent lifeline.

21 Claims, 22 Drawing Sheets

(51) Int. Cl.
*A62B 1/10* (2006.01)
*A62B 35/00* (2006.01)
*A62B 1/16* (2006.01)

(52) U.S. Cl.
CPC ..... *A62B 35/0037* (2013.01); *A62B 35/0093* (2013.01)

(56) References Cited

U.S. PATENT DOCUMENTS 876,840 A 1/1908 Reuter
939,375 A 11/1909 Andrews
1,352,230 A * 9/1920 Vescovi ..... A62B 1/14 182/240
1,444,015 A * 2/1923 Vescovi ..... A62B 1/10 182/240
1,472,446 A 10/1923 Wanderley
1,574,529 A 2/1926 Abraham
2,500,884 A 3/1950 Tessin
2,515,325 A 7/1950 Wylie
2,744,673 A 5/1956 Freeland
2,855,028 A 10/1958 Matthews
3,008,561 A * 11/1961 Landgraf ..... B41J 32/00 400/208.1
3,235,031 A 2/1966 Cenker
3,630,488 A 12/1971 Stangl
3,915,432 A 10/1975 Bustamante
4,114,875 A 9/1978 Deluty
4,130,176 A 12/1978 Paulie
4,171,795 A 10/1979 Bianchi
4,253,218 A 3/1981 Gibbs
4,286,690 A 9/1981 Gastine
4,301,892 A 11/1981 Arce
4,394,992 A 7/1983 Föhl
4,437,546 A 3/1984 Marinoff et al.
4,487,292 A 12/1984 Smith et al.
4,511,123 A 4/1985 Ostrobrod
4,576,248 A 3/1986 Marom
4,588,045 A 5/1986 Walker, Sr.
4,588,046 A 5/1986 Van der Neer
4,589,523 A 5/1986 Olson et al.
4,877,110 A 10/1989 Wolner
4,938,435 A 7/1990 Varner et al.
5,042,613 A 8/1991 Hermann
5,060,758 A 10/1991 Ishioka
5,067,585 A 11/1991 Bell
5,076,394 A 12/1991 Sheu
5,131,490 A 7/1992 Bell
5,343,976 A 9/1994 Ostrobrod
5,360,082 A 11/1994 Bell
5,466,082 A 11/1995 Sherar
5,682,962 A 11/1997 Lo
5,829,548 A 11/1998 Ostrobrod
5,850,893 A 12/1998 Hede et al.
5,878,833 A 3/1999 Bell
5,924,522 A 7/1999 Ostrobrod
5,927,438 A 7/1999 Ostrobrod
6,029,777 A 2/2000 Rogelja
6,263,999 B1 7/2001 Atkinson et al.
6,371,244 B2 4/2002 Okamura
6,530,454 B1 3/2003 Renton et al.
6,591,461 B2 7/2003 Salentine et al.
6,648,101 B2 11/2003 Kurtgis
6,666,299 B2 12/2003 Cole
6,672,428 B2 1/2004 Gelman
6,763,913 B1 7/2004 Adams
6,808,046 B1 10/2004 Henson
6,988,589 B2 1/2006 Ribic
6,990,928 B2 1/2006 Kurtgis
7,188,704 B2 3/2007 Renton et al.
7,963,370 B2 6/2011 Hwang
8,061,479 B2 11/2011 Harris, Jr.
8,226,024 B2 7/2012 Meillet
8,245,817 B2 8/2012 Casebolt
8,251,176 B2 8/2012 Meillet et al.
8,276,712 B2 10/2012 Smith et al.
8,312,964 B2 11/2012 Harris, Jr.
8,413,763 B2 * 4/2013 Hermann ..... A62B 99/00 182/18
8,757,324 B2 6/2014 Renton et al.
8,794,392 B2 8/2014 Kowatsch
8,931,593 B2 1/2015 Harris, Jr.
9,427,607 B2 * 8/2016 Renton ..... A62B 1/08
2004/0065508 A1 4/2004 Avots et al.
2004/0245048 A1 12/2004 Ribic
2005/0039979 A1 2/2005 Gorman et al.
2005/0217937 A1 10/2005 Rohlf
2006/0113147 A1 * 6/2006 Harris, Jr. ..... A62B 35/0093 182/3
2007/0158139 A1 7/2007 Moon et al.
2009/0071750 A1 * 3/2009 Simard ..... A62B 1/14 182/5
2009/0084631 A1 4/2009 Casebolt
2009/0173578 A1 * 7/2009 Renton ..... A62B 1/14 182/235
2010/0025157 A1 * 2/2010 Casebolt ..... A62B 35/0093 182/231
2010/0122874 A1 5/2010 Harris, Jr.
2010/0163338 A1 7/2010 Wood
2010/0229357 A1 9/2010 Sample et al.
2010/0252366 A1 10/2010 Jones et al.
2010/0282541 A1 11/2010 Renton et al.
2011/0100755 A1 * 5/2011 Meillet ..... A62B 1/10 182/234
2011/0174914 A1 * 7/2011 Yang ..... A62B 1/10 242/395.1
2012/0073904 A1 3/2012 Harris, Jr.
2013/0240298 A1 * 9/2013 Naylor ..... A62B 35/00 182/231
2014/0041960 A1 * 2/2014 Jones ..... A62B 35/0037 182/5
2014/0190770 A1 7/2014 Renton et al.
2014/0224583 A1 8/2014 Wood
2016/0244255 A1 * 8/2016 Chynoweth ..... B65D 90/46
2016/0367844 A1 * 12/2016 Yang ..... A62B 35/0093

FOREIGN PATENT DOCUMENTS

CN 2162259 4/1994
CN 2304435 Y 1/1999
DE 2117942 A1 10/1972
DE 3015507 A1 10/1981
DE 3347725 A1 7/1985
DE 9201882 U1 4/1992
DE 4232107 A1 3/1994
EP 0272908 A2 6/1988
EP 1 149 762 A1 10/2001
EP 2495017 A1 5/2012
EP 2786783 10/2014
EP 3013436 7/2019
FR 2 483 791 A1 12/1981
GB 191105882 A 5/1911
GB 799174 8/1958
GB 1044762 10/1966
GB 1 509 601 5/1978
GB 2 256 413 A 9/1992
GB 2 306 107 A 4/1997
GB 2 376 009 A 12/2002
GB 2 414 005 A 11/2005
JP S58192558 A 11/1983
JP S58208667 A 12/1983
JP 60-085761 5/1985
JP H1256979 A 10/1989
JP H03247354 A 11/1991
JP H10151214 A 6/1998
JP 2002068676 A 3/2002
WO WO 03/045500 A1 6/2003
WO WO 03/055560 A1 7/2003
WO WO 2005/110546 A1 11/2005
WO WO 2009/027619 A1 3/2009
WO WO 2010/017084 2/2010

(56) References Cited

FOREIGN PATENT DOCUMENTS

| | | | |
|---|---|---|---|
| WO | 2013/009354 | A2 | 1/2013 |
| WO | 2013/009638 | A1 | 1/2013 |
| WO | WO 2014/205479 | | 12/2014 |

* cited by examiner

PERSONAL DESCENT SYSTEM

CROSS-REFERENCE TO RELATED APPLICATIONS

This Application claims priority to U.S. Provisional Application Ser. No. 62/049,629, same title herewith, filed on Sep. 12, 2014, which is incorporated in its entirety herein by reference.

BACKGROUND

Workers who perform their tasks at heights utilize various types of safety gear to protect against fall events. Commonly used safety gear includes a safety harness that is donned by the worker and a self-retracting lifeline system that interconnects the safety harness to a support structure. If the worker experiences a fall event, a braking system in the self-retracting lifeline stops the fall. Once, the fall has stopped, however, an effective system is needed to deliver the worker to a safe location for rescue to prevent the worker from being suspended in the safety harness for an extended period of time. Moreover, in a situation where the worker is unconscious, a system is needed that allows a rescue worker to safely deliver the worker to a safe location for rescue.

For the reasons stated above and for other reasons stated below which will become apparent to those skilled in the art upon reading and understanding the present specification, there is a need in the art for an effective and efficient system to deliver a worker, who has encountered a fall event, to a safe location for rescue.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a personal descent system is provided. The personal descent system includes a support structure coupling assembly and a control descent device. The support structure coupling assembly is configured and arranged to be coupled to a descent lifeline. The support structure coupling assembly includes an adaptor connection member. The adaptor connection member is configured and arranged to couple different types of lifelines and lanyards to the support structure coupling assembly. The control descent device is selectively coupled to the support structure coupling assembly. The control descent device is configured and arranged to be coupled to a safety harness donned by a user. The control descent device is further configured to detach from the support structure coupling assembly during a descent operation while controlling a payout of the descent lifeline.

In another embodiment, another personal descent system is provided. The personal descent system includes a descent lifeline, a support structure coupling assembly and a control descent device. The support structure coupling assembly includes a main connection member and a D-ring. The main connection member includes a latch arm mounting aperture. The descent lifeline is coupled to the main connection member. The D-ring is coupled to the main connection member. The control descent device includes a housing, a latch arm, a brake assembly and a self-deployment system. The housing is configured and arranged to be coupled to a safety harness donned by a user. The latch arm is pivotally coupled to the housing. The latch arm is selectively received within the latch arm mounting aperture of the main connection member to selectively couple the support structure coupling assembly to the control descent device. The brake assembly is received within the housing. The brake assembly is engaged with the descent lifeline to control a payout of the descent lifeline. The self-deployment system is configured and arranged to selectively release the latch arm to allow the latch arm to pivot in relation to the housing therein causing the latch arm to be removed from the latch arm mounting aperture of the main connection member.

In another embodiment, still another personal descent system is provided. The personal descent system includes a descent lifeline, a support structure coupling assembly, a control descent device and a spool. The support structure coupling assembly includes a main connection member and an adaptor connection member, the main connection member has a latch arm mounting aperture. The descent lifeline is coupled to the main connection member. The adaptor connection member is coupled to the main connection member. The adaptor connection member is configured and arranged to couple a support lifeline to the support structure coupling assembly. The control descent device includes a housing, a latch arm and a brake system. A pair of spaced descent connecting arms extend from the housing. The pair of spaced descent connection arms have aligned routing apertures. The latch arm is pivotally coupled between the descent connection arms. The latch arm is selectively received with the latch arm mounting aperture of the main connection member to selectively couple the support structure coupling assembly to the control descent device. The brake system is contained within the housing. The brake assembly is engaged with the descent lifeline to at least in part control a payout of the descent lifeline. The spool is used to hold at least a portion of the descent lifeline. The descent lifeline is routed from the spool into an entry to the housing, through the brake system in the housing, out an exit in the housing, through the aligned routing apertures in the descent connection arms to the main connector member.

In further still another embodiment, another personal descent system is provided. In this embodiment the personal descent system includes a descent lifeline, a support structure and a control descent device, a spool and a sealing container. The support structure coupling assembly is configured and arranged to be coupled to a descent lifeline. The control descent device is selectively coupled to the support structure coupling assembly. The control decent device includes a housing, a breakaway seal, a brake assembly and a self-deployment system. The housing is configured and arranged to be coupled to a safety harness donned by a user. The housing has an entry passage for the descent lifeline to enter the housing and an exit passage to exit the housing. The breakaway seal is positioned near the exit to the housing. The brake assembly is received within the housing. The brake assembly is engaged with the descent lifeline to control a payout of the descent lifeline. The self-deployment system is configured and arranged to selectively disconnect the control descent device from the support structure coupling assembly. The spool is configured and arranged to hold at least a portion of the decent line. The descent lifeline passes from the spool into the entry passage to the housing. The sealing container is positioned around the spool to prevent moisture and debris from reaching the descent lifeline on the spool.

BRIEF DESCRIPTION OF THE DRAWINGS

The present invention can be more easily understood and further advantages and uses thereof will be more readily apparent, when considered in view of the detailed description and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Figure 1:
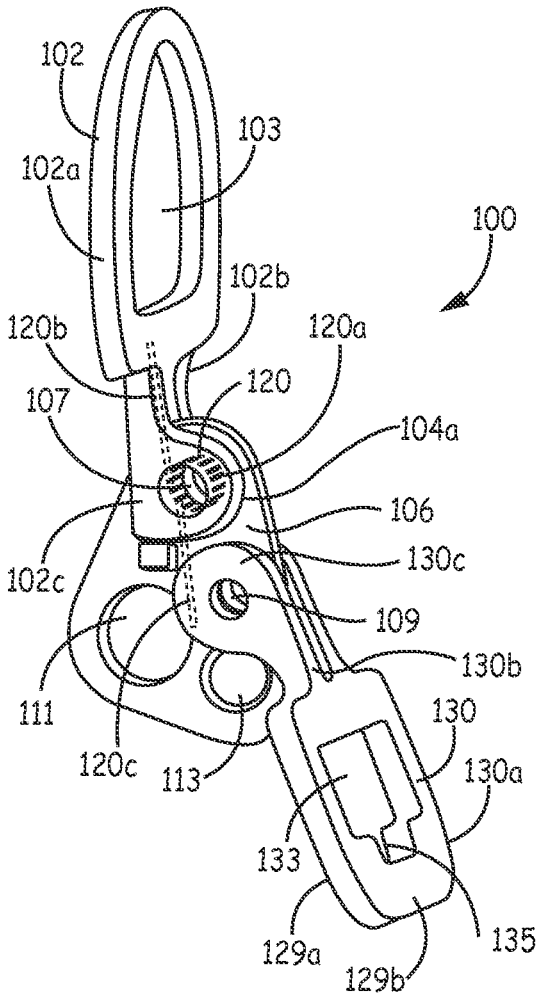
FIG. 1 is a side perspective view of a support structure coupling assembly of one embodiment of the present invention.

Embodiments of the present invention provide a personal descent system 200 that can be used in a rescue situation. Referring to FIG. 1, a side perspective view of a support structure coupling assembly 100 which makes up part of the personal descent system 200 in an embodiment illustrated. The support structure coupling assembly 100 includes a D-ring 102. The D-ring 102 has a rescue portion 102*a* that forms a rescue aperture 103 and a neck portion 102*b* in this embodiment. A lifeline (not shown) or the like can be attached to the rescue portion 102*a* in a rescue situation. The neck portion 102*b* of the support structure coupling assembly 100 extends from the rescue portion 102*a*. The neck portion 102*b* leads to a D-ring connection portion 102*c*. In particular, the neck portion 102*b* of the D-ring 102 is positioned between the rescue portion 102*a* and the D-ring connection portion 102*c* of the support structure coupling assembly 100. The D-ring connection portion 102*c* includes a pair of arms 104*a* and 104*b* that are illustrated best in FIG. 2A. A portion of a main connection member 106 is positioned between the pair of arms 104*a* and 104*b* of the support structure coupling assembly 100. A pivot connection pin 105 pivotally couples the D-ring 102 to the main connection member 106 via apertures through the arms 104*a* and 104*b* of the D-ring connection portion 102*c* of the D-ring 102 and a D-ring connection aperture 107 (illustrated in FIG. 1) of the main connection member 106. The main connection member 106 is shaped to position various connection apertures 107, 109, 111 and 113 in relation to each other. In the embodiment of FIG. 1, the main connection member 106 has generally a triangular shape with rounded corners. The spaced connection apertures 107, 109, 111 and 113 include the D-ring connection aperture 107 discussed above, an adapter member aperture 109, a latch arm mounting aperture 111 and a descent lifeline termination aperture 113. The support structure coupling assembly 100 further includes a D-ring biasing member 120, which in the embodiment of FIG. 1 is a spring. The D-ring biasing member 120 includes a coil portion 120*a* that, in the embodiment shown, is positioned around at least a portion of the pivot connection pin 105. The D-ring biasing member 120 includes a first arm portion 120*b* received within a cavity of the neck portion 102*b* of the D-ring 102 and a second arm portion 120*c* received within a cavity in the main connection member 106. The D-ring biasing member 120 biases the D-ring 102 in an access position so that the rescue portion 102*a* is accessible, extending in an upward position, when the support structure coupling assembly 100 is attached to a safety harness 600 (illustrated in FIG. 8). The D-ring 102 not only is used during rescue situations, as described above, it is also intended to be used as an attachment point of a lanyard to be used as the wearer's primary lifeline if the user chooses to use a lanyard instead of a SRL.

Referring back to FIG. 1, also attached to the main connection member 106 of the support structure coupling assembly 100 is an adaptor connection member 130. The adaptor connection member 130 includes a receiving head portion 130*a*, a neck portion 130*b* and a base connector portion 130*c*. The neck portion 130*b* is positioned between the receiving head portion 130*a* and the base connector portion 130*c*. The base connector portion 130*c* includes a first arm 131*a* and a second arm 131*b* best shown in FIG. 2A. A connector pin 132 passing through aligned apertures in the first arm 131*a* and the second arm 131*b* of the adaptor connection member 130 and the adapter member aperture 109 of the main connection member 106, pivotally couples the adaptor connection member 130 to the main connection member 106. The receiving head portion 130*a* of the adaptor connection member 130 includes a receiving passage 133 that is shaped to receive a self-retracting lifeline (SRL) coupling member as described below in detail. The shape of the receiving passage 133 in this example embodiment is generally rectangular shaped with a notch 135 in one edge that forms part of the rectangle shape. The receiving head portion 130*a* of the adaptor connection member 130 further includes a first surface 129*a* and an opposed second surface 129*b*.

Figure 2B:
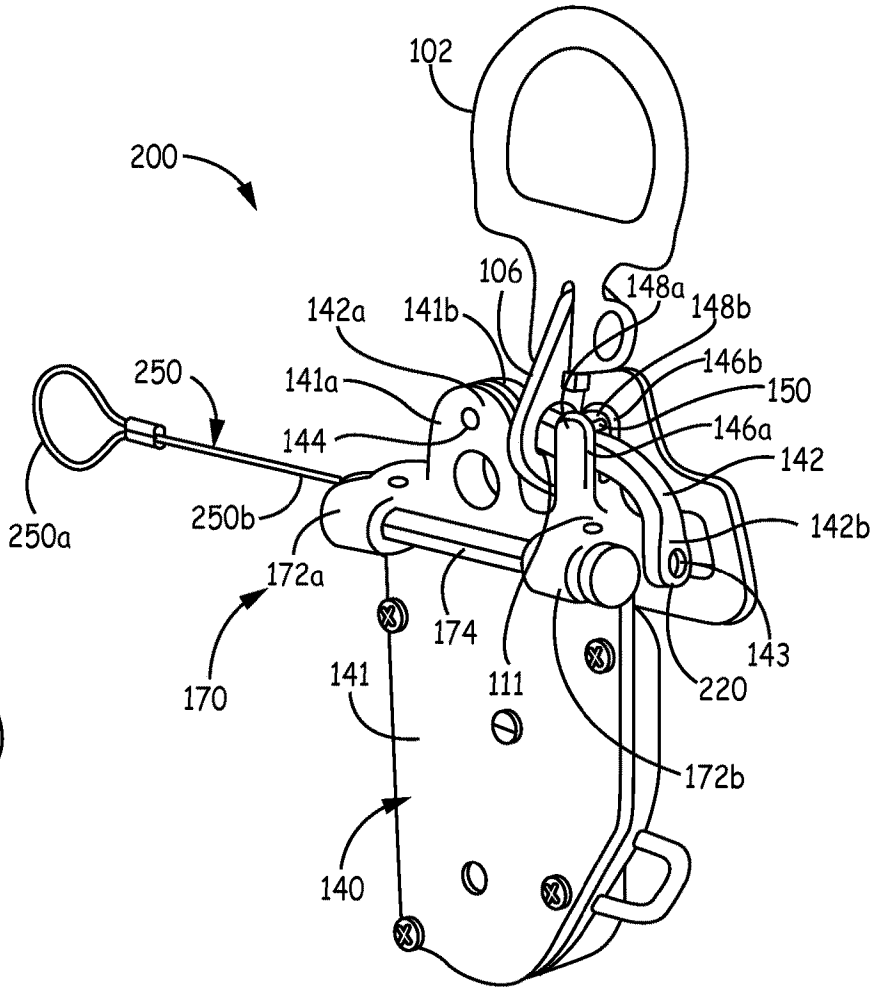
FIG. 2B is a rear perspective view of the personal descent system of FIG. 2A.

Selectively attached to the support structure coupling assembly 100 is a control descent device 140 that makes up the personal descent system 200. The personal descent system 200 is illustrated in the front perspective view of FIG. 2A and the rear perspective side view of FIG. 2B. The control descent device 140 is used in case of a rescue situation to provide a controlled descent. The control descent device 140 pays out a descent lifeline 202 (rope, cable, etc. shown in FIGS. 6A and 6B) at a select rate once activated to lower the worker to a desired location for rescue. This is further discussed below. As illustrated in FIG. 2B, a latch arm 142 of the control descent device 140 passes through the latch arm mounting aperture 111 of the main connection member 106 to selectively couple the control descent device 140 to the support structure coupling assembly 100. The latch arm 142 includes a first end portion 142*a* that is pivotally coupled between descent connection arms 141*a* and 141*b* of a housing 141 of the control descent device 140 via pivot connector 144. The latch arm 142 further has a second end portion 142*b*. The second end portion 142*b* of the latch arm 142 includes a lock aperture 143 in which a lock pin 252 is selectively received to selectively lock the latch arm 142 in relation to the control descent device 140 which is also further discussed below. The descent housing further includes fuse connecting arms 146*a* and 146*b*. The fuse connecting arms 146*a* and 146*b* have aligned fuse bores 148*a* and 148*b* in which a fuse 150 is held. The fuse 150 prevents unintentional deployment of the control descent device 140. The rear perspective view of FIG. 2B also illustrates a safety harness connecting assembly 170 that includes a pair of spaced harness connection arms 172*a* and 172*b* that extend out from the rear of the housing 141. A housing connect pin 174 passes through aligned passages in the harness connection arms 172*a* and 172*b*. Safety harness webbing 602 and 604 (or straps) of a safety harness 600 (illustrated in FIG. 8) are positioned between the housing connect pin 174 and the descent housing 141 to couple the personal descent system 200 to the safety harness 600. In one embodiment, the location where the webbings 602 and 604 of the safety harness 600 cross in the back of a user is where the webbings 602 and 604 are coupled to the personal descent system 200.

Figure 2A:
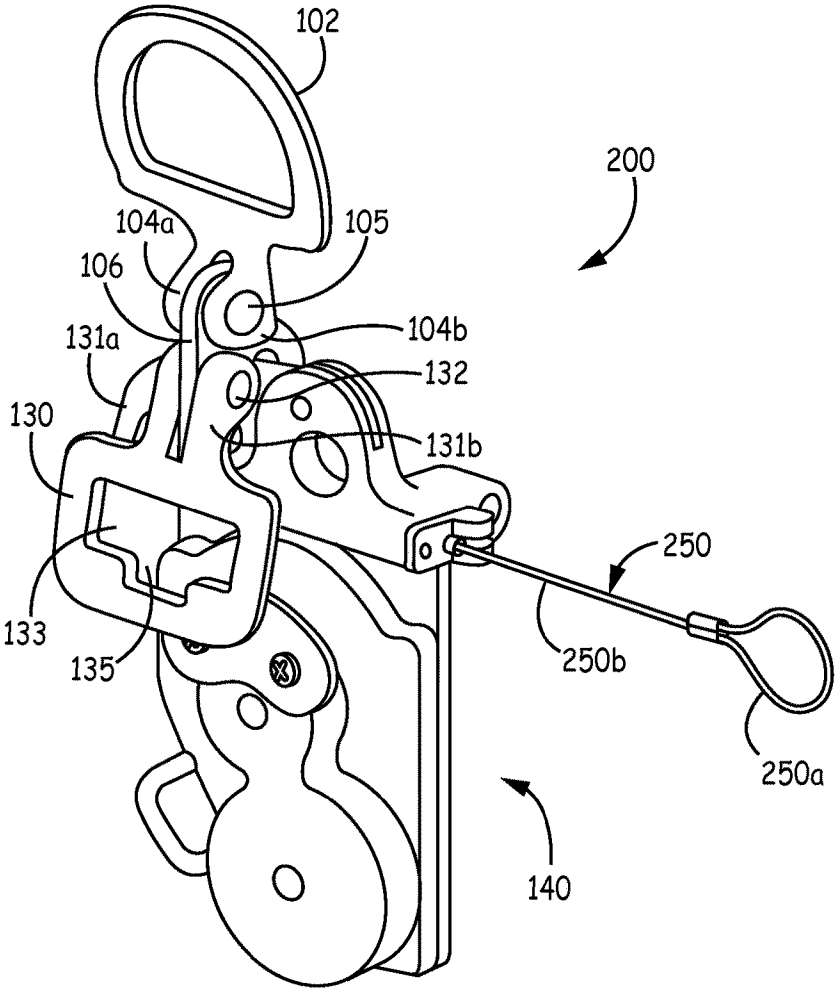
FIG. 2A is a front perspective view of a personal descent system of an embodiment of the present invention including the support structure coupling assembly of FIG. 1.
Figure 2C:
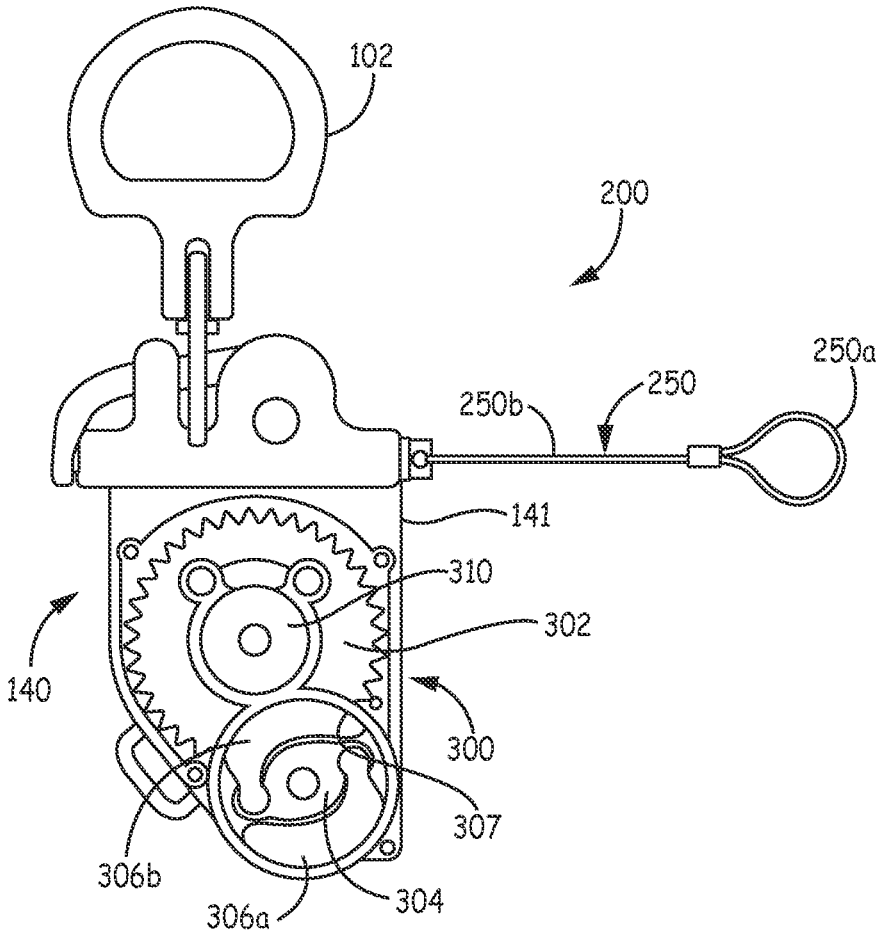
FIG. 2C is a partial front cut away view of the personal descent system of FIG. 2A illustrating the braking components of the control descent device in one embodiment of the present invention.
Figure 6A:
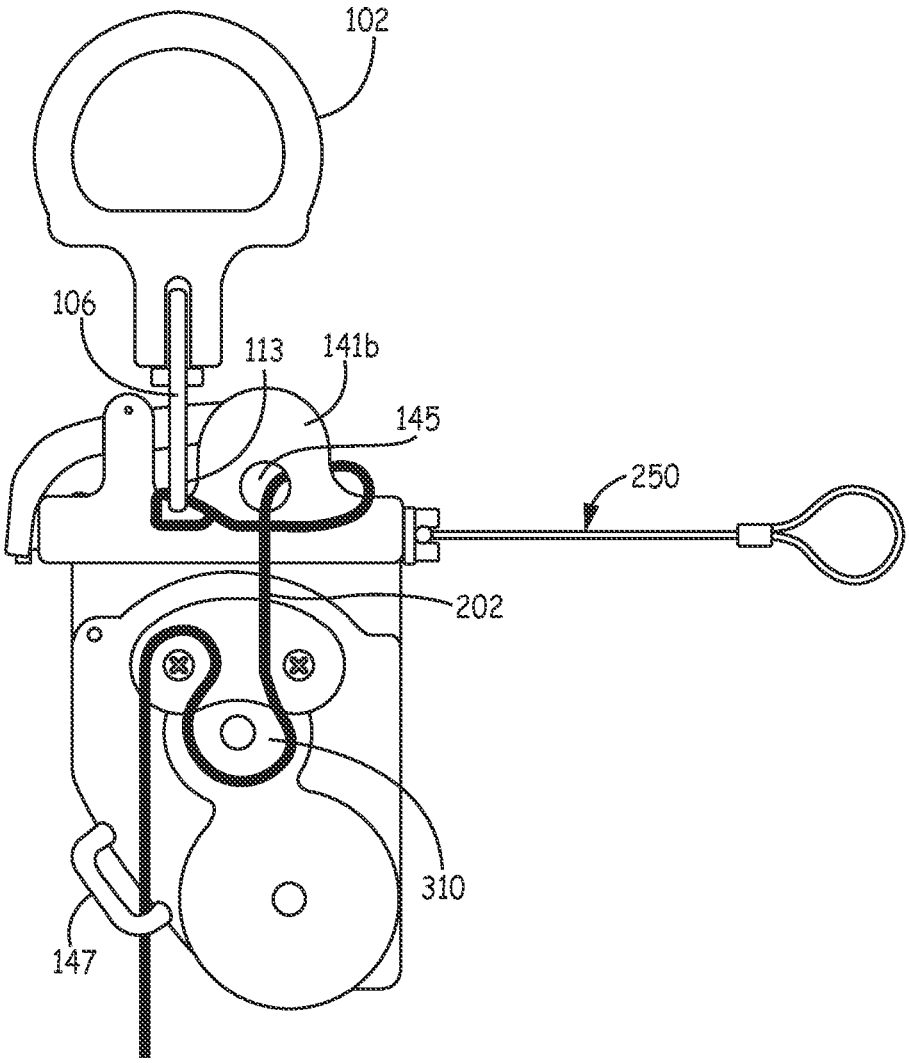
FIG. 6A is a front view of the personal descent system of FIG. 2A illustrating a rope routing before deployment in an embodiment of the present invention.

Also illustrated in FIGS. 2A and 2B is a self-deployment system 250 (generally referred to as a deployment system 250). The user deployment system 250 includes an end looped portion 250*a* that allows the user to grasp the user deployment system 250 and pull to activate the user deployment system 250. In one embodiment, the user deployment system 250 is made from a wire cable. Referring to the front view of FIG. 2C, the control descent device 140 also includes a brake system 300 that helps control the payout rate of speed of the descent lifeline 202 (illustrated in FIG. 6A). The brake system 300 in this embodiment includes a main gear 302 that is rotationally coupled to a center rotor 304 via a rotor gear (not shown). Pivotally coupled to the center rotor 304 is a pair of braking pawls 306*a* and 306*b*. The braking pawls 306*a* and 306*b* rotationally engage an inner surface 307 of the housing 141 to create friction to slow the payout of the descent lifeline 202. A brake pulley 310 is coupled to rotate with the main gear 302. Moreover, the brake pulley 310 is in turn engaged with the rope as shown in FIG. 6A and described in detail below.

Figure 3A:
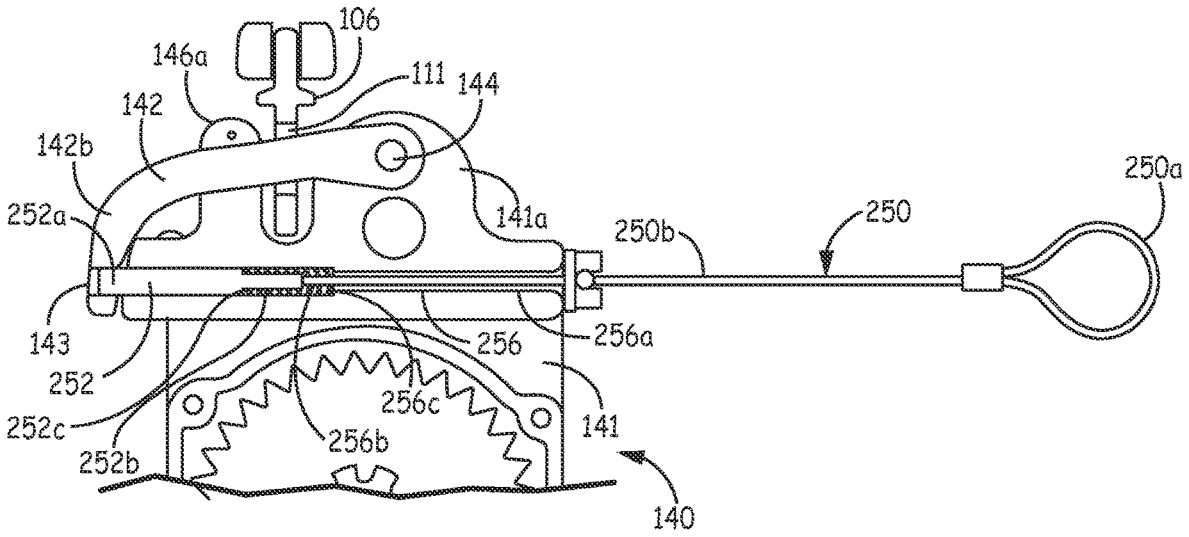
FIG. 3A is a partial front cut away view of the personal descent system of FIG. 2A before deployment in an embodiment.

A front cutaway portion of the personal descent system 200 before deployment is shown in FIG. 3A. As illustrated in FIG. 3A, the elongated portion 250*b* (self elongated portion) of the deployment system 250 is coupled to a lock pin 252. The lock pin 252 includes a first lock end 252*a* that is designed to be selectively received within the lock aperture 143 of the latch arm 142 to selectively lock the latch arm 142 in a static location in relation to the housing 141 of the control descent device 140 as illustrated in FIG. 3A. The lock pin 252 further includes a second connecting end 252*b* that is coupled to the elongated portion 250*b* of the deployment system 250. The lock pin 252 and a portion of the elongated portion 250*b* of the deployment system 250 are received within a deployment passage 256 of the housing 141. In particular, in this embodiment, the deployment passage 256 has a first portion 256*a* that has a first diameter and a second portion 256*b* that has a second larger diameter. A deployment passage shoulder 256*c* is at the transition between the first portion 256*a* and the second portion 256*b*. The first lock end 252*a* of the lock pin 252 has a first diameter that allows the first lock end 252*a* to be received snuggly in the second portion 256*b* of the deployment passage 256 and the lock aperture 143 of the latch arm 142. The second connection end 252*b* of the lock pin 252 has a second smaller diameter. A lock pin shoulder 252*c* is formed at the transition between the first lock end 252*a* and the second connecting end 252*b* of the lock pin 252. A lock biasing member 254 is received around the second connecting end 252*b* of the lock pin 252. In particular, the lock biasing member 254 (which is a spring in this embodiment) has a first end that abuts the lock pin shoulder 252*c* of the lock pin 252 and a second end that abuts the deployment passage shoulder 256*c* to bias the lock pin 252 into the lock aperture 143 of the latch arm 142.

Figure 3B:
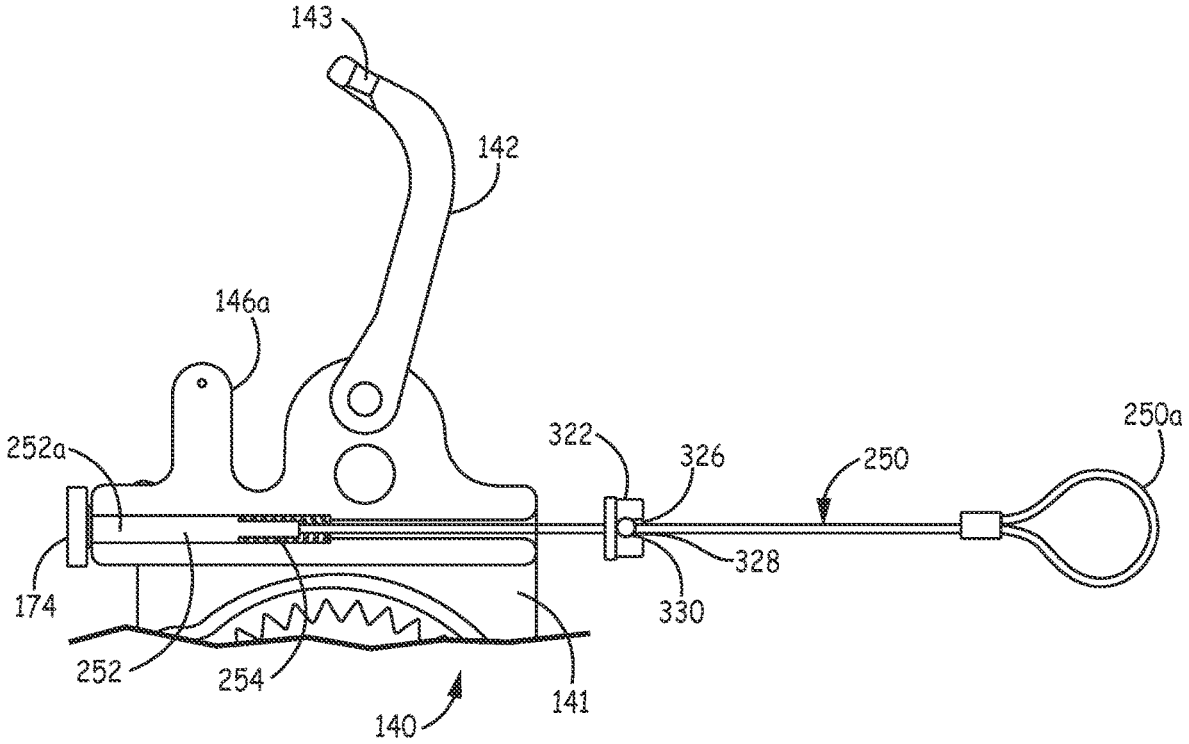
FIG. 3B is a partial front cut away view of the personal descent system of FIG. 2A after deployment in an embodiment of the present invention.

FIG. 3B illustrates a front cutaway section of a portion of the personal descent system 200 after deployment. In particular, FIG. 3A shows the deployment system 250 being pulled to counter the biasing force of the lock biasing member 254. In use, this is typically done by the user pulling on the end looped portion 250*a* of the deployment system 250. This action causes the first lock end 252*a* of the lock pin 252 to come out of the lock aperture 143 of the latch arm 142. Weight on the latch arm 142 (which would be the weight of the user during a fall event) causes the latch arm 142 to rotate on pivot connection 144 with the housing 141. When the latch arm 142 rotates, it is pulled out of the latch arm mounting aperture 111 of the main connection member 106 (shown in FIG. 3A) to release the control descent device 140 from the main connection member 106. In an embodiment, if the weight is not enough to break the fuse 150 (shown in FIG. 2B), the latch arm will not pivot open even though the lock pin is removed from the lock aperture 143 of the latch arm 142. This situation could occur when the deployment system 250 is accidentally pulled (i.e. gets caught on something) without a fall event occurring. The location of the main connection member 106 of the support structure coupling assembly 100 in relation to the latch arm 142 reduces the load on the lock pin 252 (biased towards the center of the latch arm 142) so it is easier to pull the deployment system 250. Moreover, the bottom surface of the latch arm 142 is angled so it slides easier out of the latch arm mounting aperture 111 of the main connection member 106 of the support structure coupling assembly 100 when the control descent device 140 is deployed.

Figure 4A:
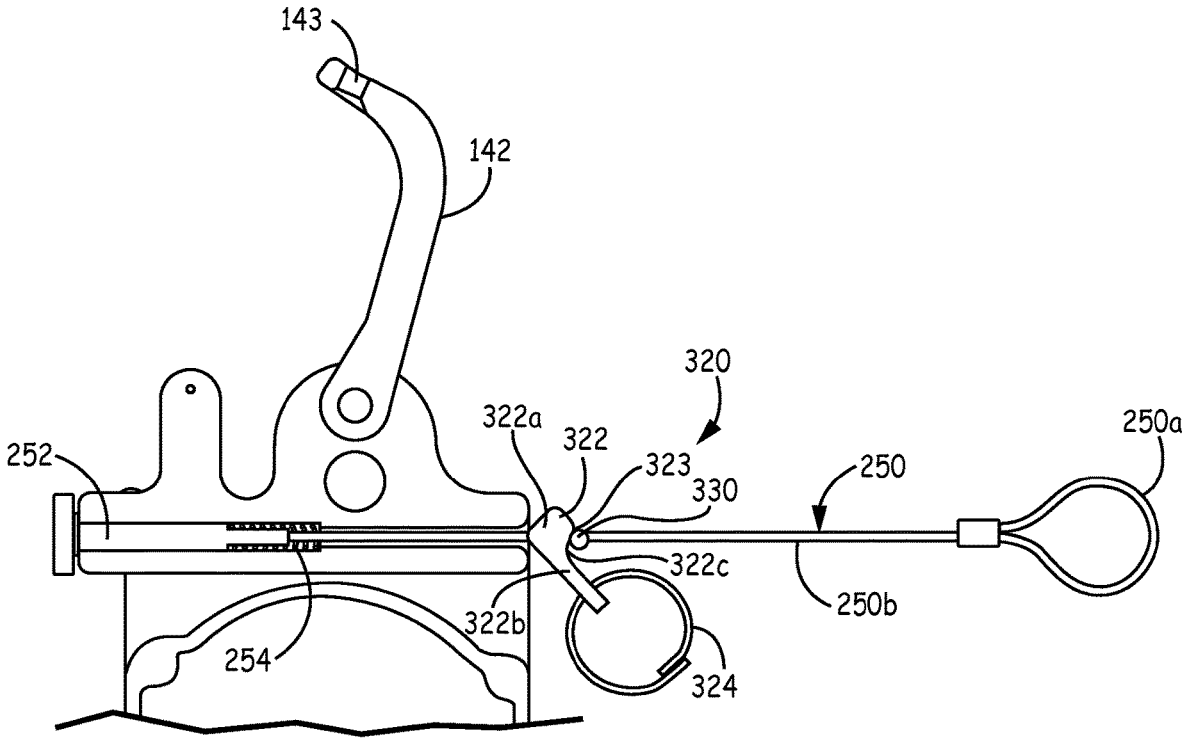
FIG. 4A is a partial front cut away view of the personal descent system of FIG. 2A during a buddy pull deployment in an embodiment of the present invention.
Figure 4B:
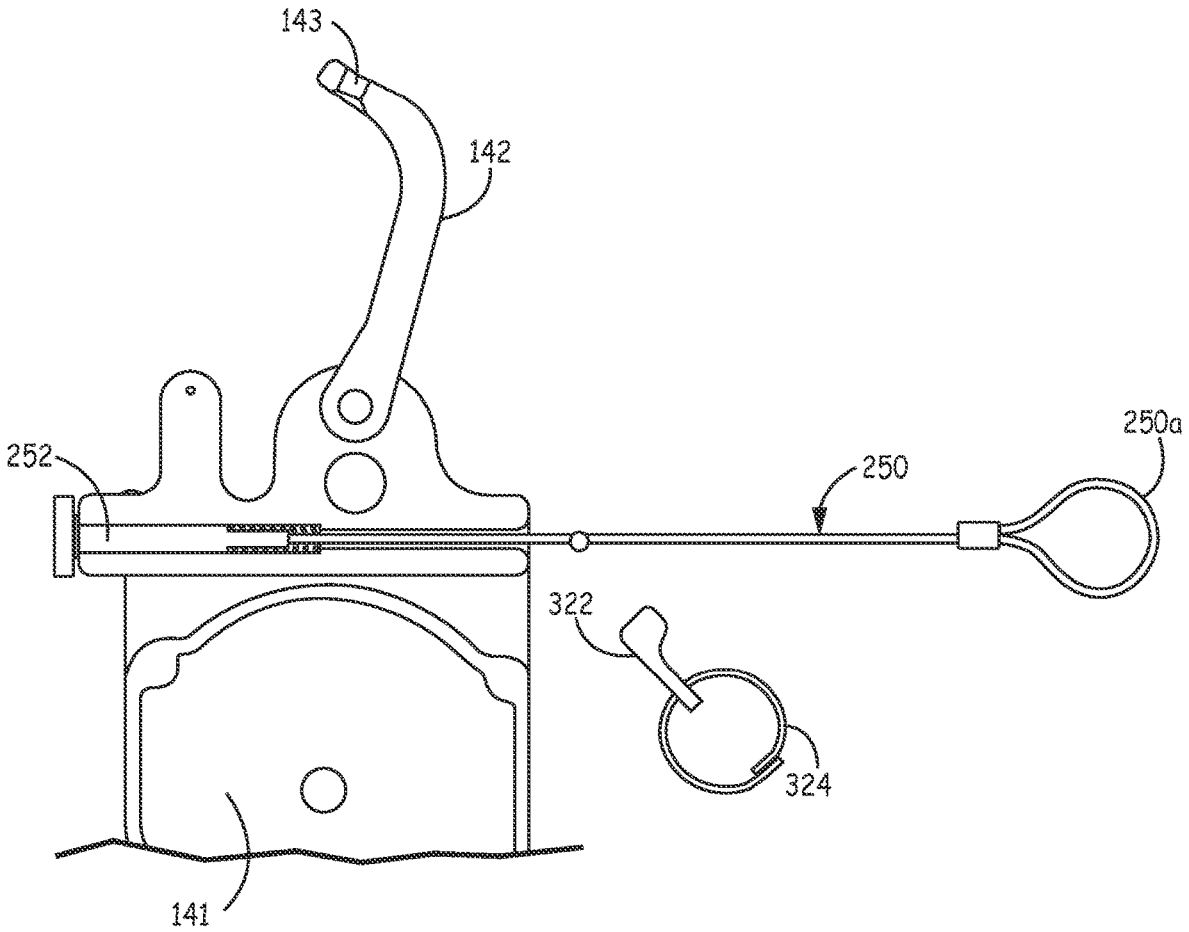
FIG. 4B is a partial front cut away view of the personal descent system of FIG. 2A after a buddy pull deployment in an embodiment of the present invention.

Embodiments also include a buddy deployment system 320 that interacts with the self-deployment system 250 (deployment system 250). The buddy deployment system 320 is used in a situation where the user is unable to activate the self-deployment system 250. This may occur if the user is unconscious or is otherwise unable to activate the deployment system 250. The buddy deployment system 320 is illustrated in FIG. 4A. In particular, FIG. 4A illustrates buddy deployment system 320 deploying the latch arm 142. The buddy deployment system 320 includes a buddy activating base member 322, a stop 330 and an engagement loop 324. The buddy activating base member 322 includes a first activation portion 322*a*, a second connection portion 322*b* and a central ramp portion 322*c* with a ramp surface 323 that transitions between the first activation portion 322*a* and the second connection portion 322*b*. The ramp surface 323, in an embodiment, has a cam surface that allows for an easy activation at any angle. The stop 330 is coupled to the self-deployment system 250 at a select location. The first activation portion 322*a* further includes a slot 326 and seat 328 (illustrated in FIG. 3B). The elongated portion 250*b* of the deployment system 250 is received within the slot 326 of the buddy activating base member 322. The diameter of the stop 330 is greater than the width of the slot 326. In an embodiment, the stop 330 rests in the seat 328 of the buddy activating base member 322 between the first activation portion 322*a* and the second connection portion 322*b* of the buddy activating base member 322 under tension provided by lock biasing member 254. To activate the buddy deployment system 320, the engagement loop 324, which is coupled to the second connection portion 322*b* of the buddy activating base member 322, is pulled. This can be done with use of a hook and pole arrangement, or the like, that is manipulated by a rescue person. When the engagement loop 324 is pulled, the stop 330 is forced along the ramp surface 323 of the central ramp portion 322*c* of the buddy activating base member 322 to the first activation portion 322*a*. Since the width of the first activation portion 322*a* is greater than the distance the lock pin 252 has to move to disengage the lock aperture 143 of the latch arm 142, movement of the stop 310, which is connected to the elongated member 250*b*, along the ramp surface 333 disengages the latch arm 142 as illustrated in FIG. 4A. The central ramp portion 322*c* of the buddy activating base member 322 has a curvature selected so that the lock biasing member 254, under normal conditions, does not force the stop 330 up the ramp surface 323 while allowing the stop 330 to ride up on the ramp surface 323 when the buddy deployment system 320 is activated. One feature of the buddy deployment system 320 is that the buddy activating base member 322 breaks away from the personal descent system 200 after deployment as illustrated in FIG. 4B. This ensures the buddy activating base member 322 and engagement loop 324 portions of the buddy deployment system 320 as well as a rescue hook and pole arrangement (not shown) will not be pulled out of the rescuer's hands during deployment.

Figure 5:
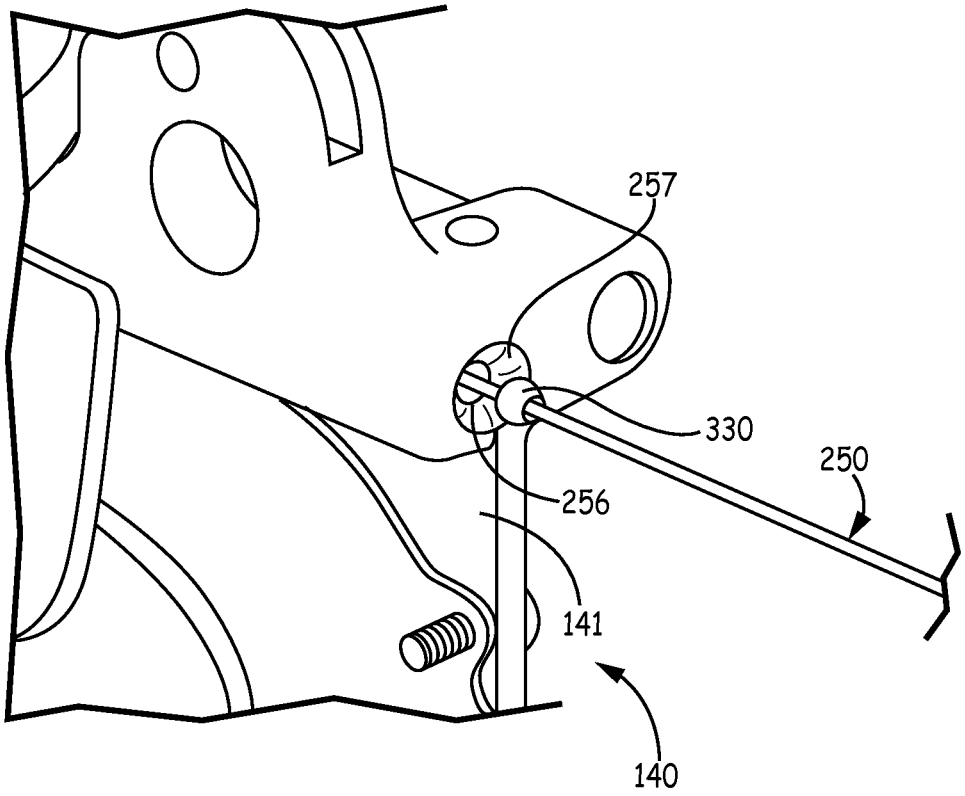
FIG. 5 is a partial front perspective view of a portion of a control descent device of one embodiment of the present invention.

Referring to FIG. 5, a portion of the housing 141 is illustrated. In this illustration, an opening to the deployment passage 256 in an embodiment is shown. In this embodiment the opening includes a conical mouth 257 having a select curvature so that no matter which direction the elongated member 250*b* of the deployment system 250 is pulled for activation in relation to the descent housing 141, the opening configuration does not impede movement of the deployment system 250.

Figure 6B:
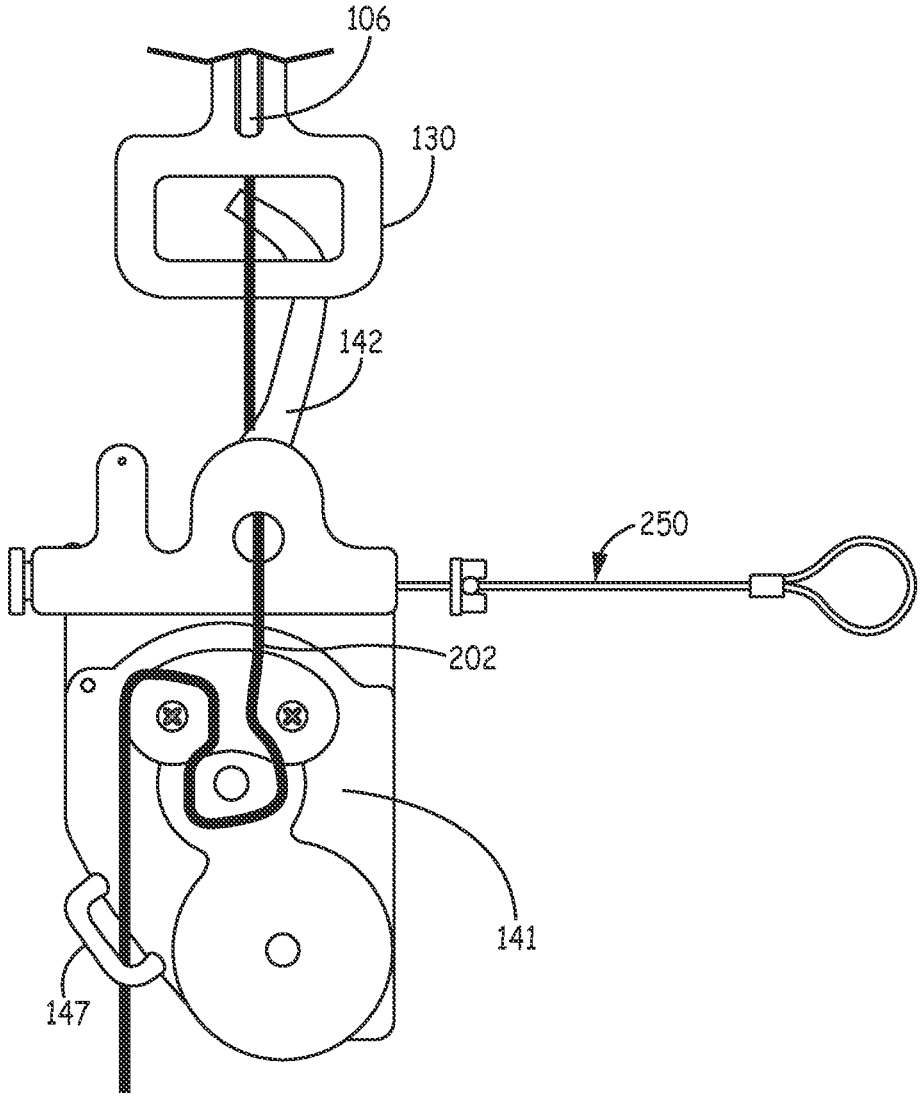
FIG. 6B is a front view of the personal descent system of FIG. 2A illustrating the rope routing after deployment in an embodiment of the present invention.
Figure 9:
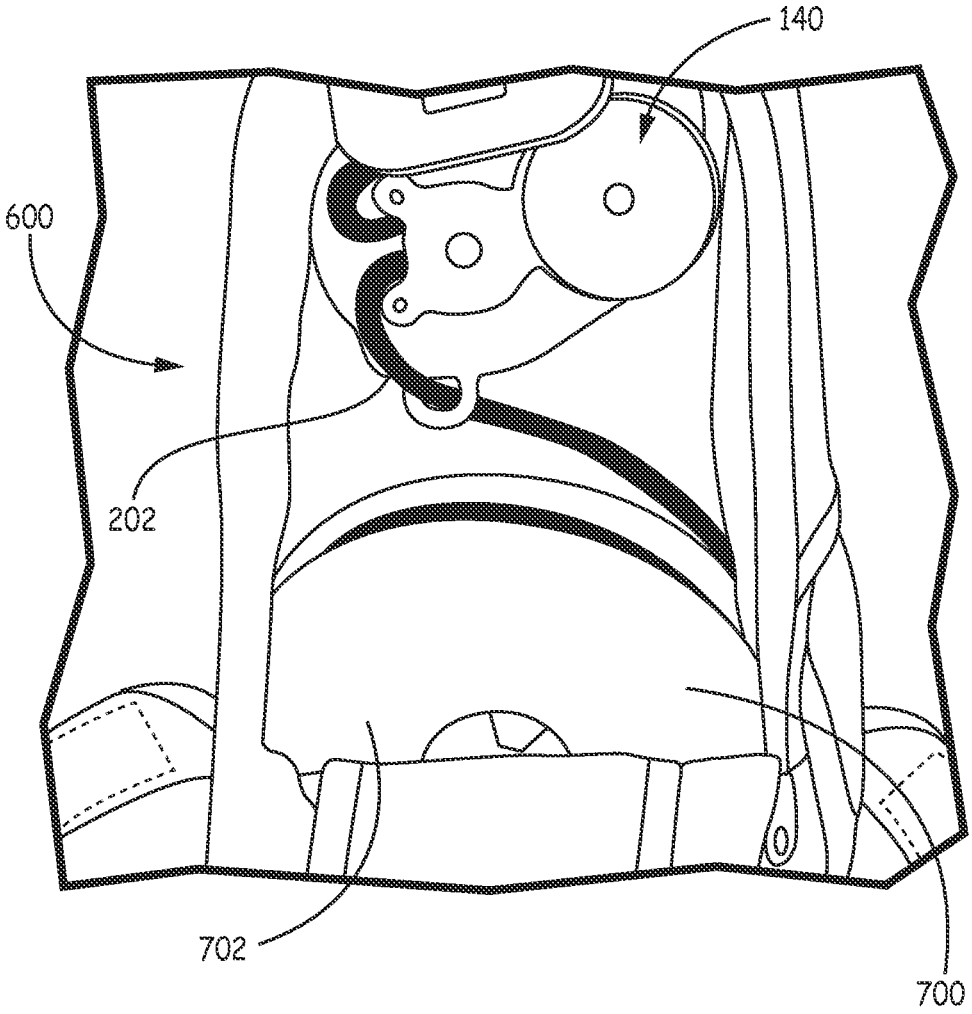
FIG. 9 is a partial front perspective view of the control descent device and rope dispensing spool in one embodiment of the present invention.

Routing of the descent lifeline 202 is illustrated in FIG. 6A. In particular, FIG. 6A illustrates the descent lifeline 202 routing before deployment of the personal descent system 200. Descent lifeline 202 that is stored on a spool 700 in a pouch 702 of a safety harness 600 (shown in FIG. 9) is routed through routing bracket 147, around brake pulley 310 of the brake system 300, it is then looped through routing apertures 145 in the descent connection arms 141*a* and 141*b* of the descent housing 141 and then tied to a descent lifeline termination aperture 113 of the main connection member 106 as illustrated in FIG. 6A. Referring to FIG. 6B, rope routing after deployment is illustrated. As illustrated in FIG. 6B, the latch arm 142 is released by the deployment system 250. Hence, the latch arm 142 no longer engages the main connection member 106 therein allowing the main connection member to separate from the housing 141. The rate of separation of the main connection member 106 (and D-ring 102) is controlled by the descent lifeline 202 passing through the brake system 300 and the routing path as set out above. The routing path provides friction on the descent lifeline 202. In other embodiments, the descent lifeline 202 is stored via other means than a spool, such as but not limited to, being flaked in a bag, tucking multiple folds of the descent lifeline into elastic, etc.

Figure 7B:
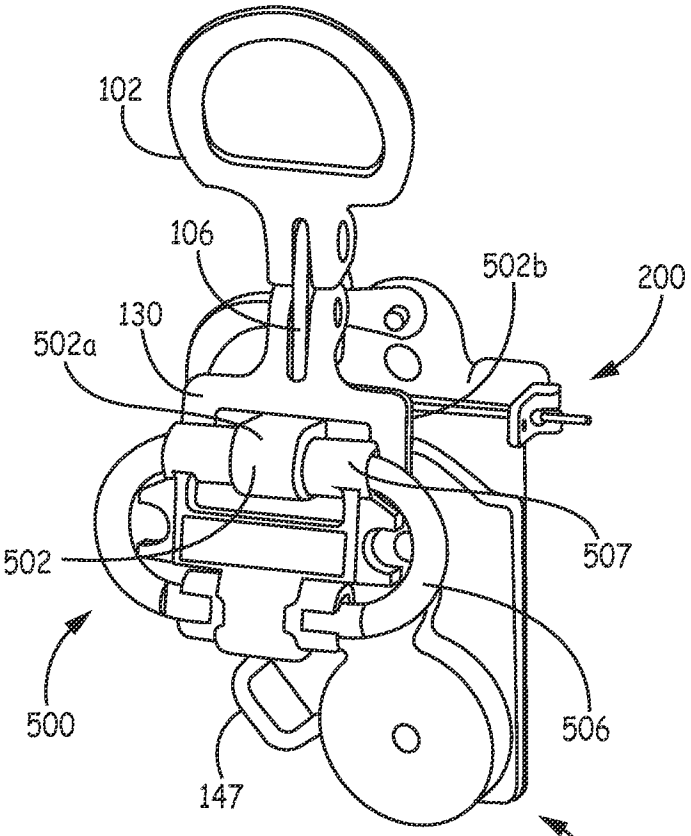
FIG. 7B is a front perspective view of the personal descent system of FIG. 2A coupled to another self-retracting lifeline connector of another embodiment of the present invention.
Figure 7A:
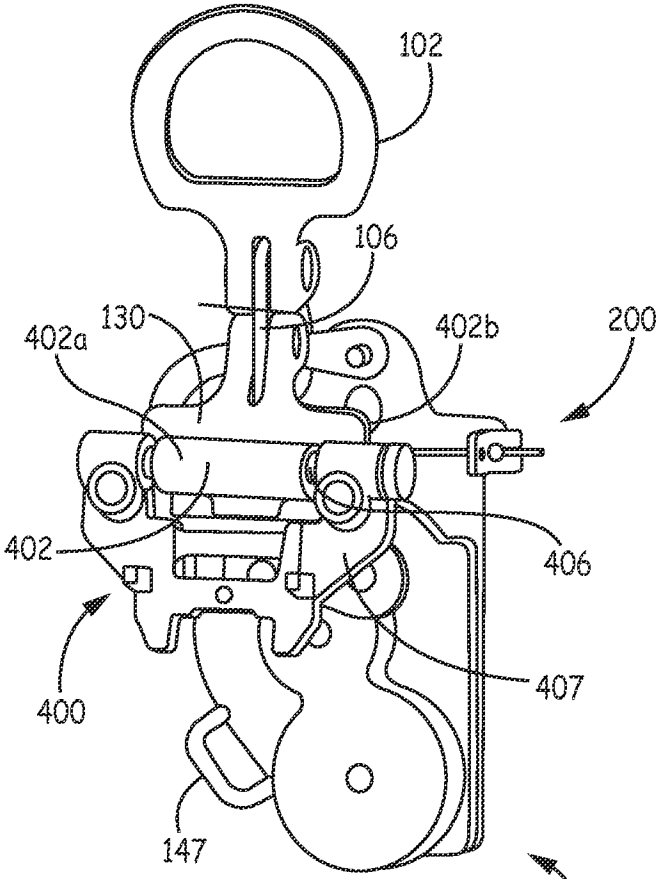
FIG. 7A is a front perspective view of the personal descent system of FIG. 2A coupled to a self-retracting lifeline connector of one embodiment of the present invention.

As discussed above, the adaptor connection member 130 that is coupled to the main connection member 106 can be used to couple different types of SRLs or other suitable lifelines or lanyards to the base plate 106. Referring to FIG. 7A, an example of the adaptor connection member 130 being used to connect a Nano-Lok™ edge attachment system 400 for a DBI-SALA® SRL (not shown) from the Capital Safety USA of Red Wing, Minn. is illustrated. The Nano-Lok™ Edge attachment system 400 includes a coupling member 402. The coupling member 402 has a first portion 402*a* that is sized to pass through the receiving passage 133 (shown in FIG. 1) of the adaptor connection member 130 while a second plate portion 402*b* of the coupling member 402 is designed to engage the first surface 129*a* (indicated in FIG. 1) of the adaptor connection member 130. A locking pin 406 of a connector 407 is received in a holding aperture in the first portion 402*a* of the coupling member 402 to lock the connector 407 to the adaptor connection member 130. In particular, the configuration positions the connector 407 to engage the second surface 129*b* of the adaptor connection member 130. Since the connector is sized larger than the receiving passage 133 of the adaptor connection member 130, and therefore cannot be pulled through the receiving passage 133, the connector 404 is locked to the adaptor connection member 130. An example of a different attachment system is illustrated in FIG. 7B. This example attachment system is a Nano-Lok™ attachment system 500 for a DBI-SALA® Nano-Lok™ SRL (not shown) from Capital Safety USA of Red Wing, Minn. This attachment system 500 includes a coupling member 502 that has a first portion 502*a* that passes through the receiving passage 133 (shown in FIG. 1) of the adaptor connection member 130. A second portion 502*b* of the coupling member 502, which does not fit through the receiving passage 133, engages the first surface 129*a* of the adaptor connection member 130. The attachment system further includes connector 506. The connector 506 includes a connection portion 507 that is designed to be received within a bore of the first portion 502*a* of the coupling member 131. Since connector 506 is larger than the receiving passage 133 of the adaptor connection member 130, the connector 506 cannot be pulled through the receiving passage 133 therein locking NanoLok™ attachment system 500 to the adaptor connection member 130. It is recognized that other suitable coupling members could be used to accommodate other types of lifelines or lanyards.

Figure 8:
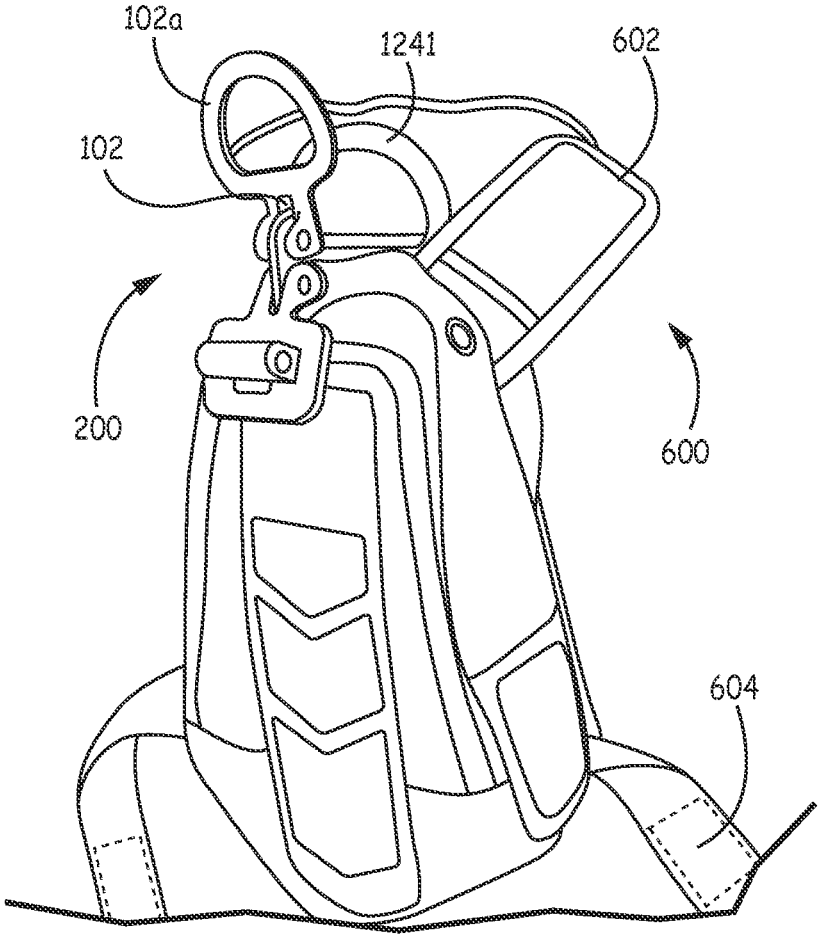
FIG. 8 is a front perspective view of the personal descent system of FIG. 2A coupled to a safety harness in one embodiment of the present invention.

As discussed above, FIG. 8 illustrates an embodiment of the personal descent system 200 attached to a safety harness 600. As illustrated in FIG. 8, the rescue portion 102*a* of the D-ring 102 is biased up in a position so that it can be easily accessed in a rescue situation. Hence, the personal descent device 200 provides two methods of rescue, the first being via engagement of the D-ring 102 to move the worker to safety and the second is through the deployment of the control descent device 140 to lower the worker to safety. In addition, the self-deployment system 250 may be operationally coupled to the shoulder strap for ease of use. Moreover, as discussed above, as shown in FIG. 9, a pouch 702 is attached to the safety harness 600 in an embodiment to hold the spool 700 of the descent lifeline 202 that is provided to the control descent device.

Figure 10:
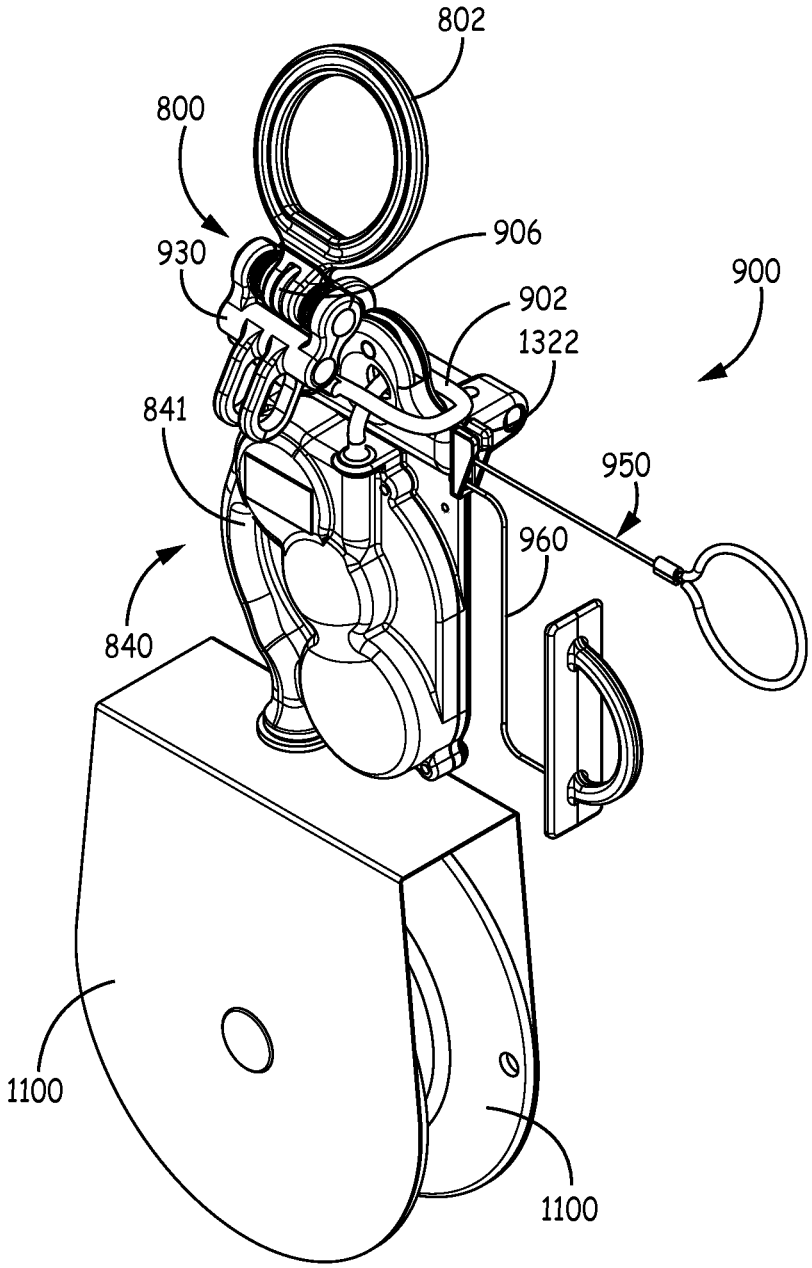
FIG. 10 is a side perspective view of a personal descent system of another embodiment of the present invention.
Figure 11:
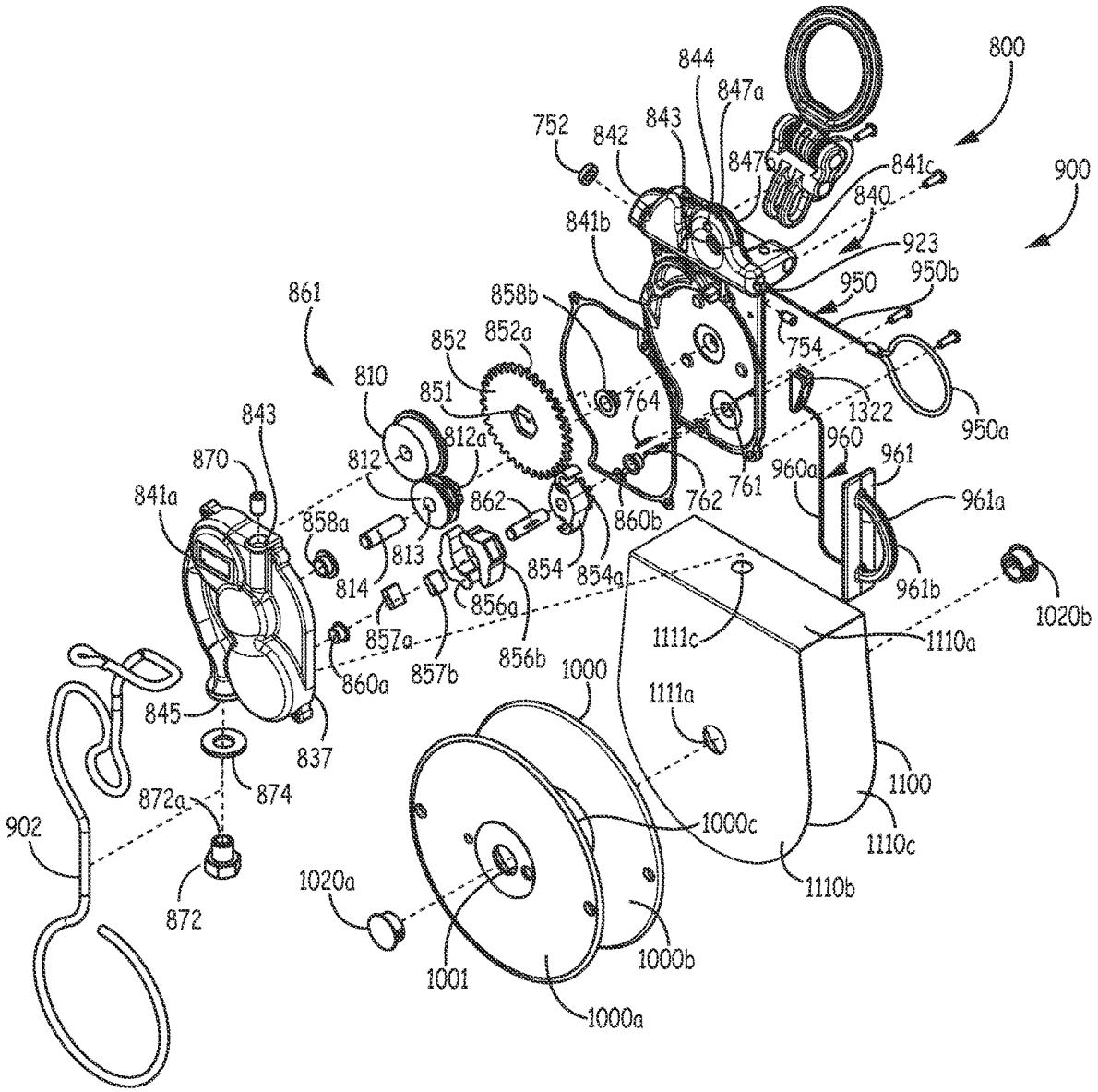
FIG. 11 is a side perspective partial unassembled view of the personal descent system of FIG. 10.

Referring to FIG. 10, a second embodiment of a personal descent system 900 is provided. This embodiment includes a support structure coupling assembly 800, a control descent device 840 and descent lifeline 902. The support structure coupling assembly 800 generally includes a D-ring 802, a main connection member 906, and an adaptor connection member 930 as discussed below. The control descent device 840 generally includes a housing 841, a self-deployment system 950, a buddy deployment system 960 with a buddy activation base member 1322. The personal descent system 900 in this embodiment further includes a spool bracket 1100 and a spool 1000 to hold the descent lifeline 902. A partial unassembled view of the personal descent system 900 is illustrated in FIG. 11. This view illustrates the control descent device 840 which includes a first housing portion 841*a* and a second housing portion 841*b* that make up a housing 841. In one embodiment, the first housing portion 841*a* and the second housing portion 841*b* are hermetically sealed to each other with a housing seal 750. Housed within a cavity formed by the first housing portion 841*a* and the second housing portion 841*b*, is a brake assembly that is generally designated as 861. The brake assembly 861 includes a main gear 852. The main gear 852 includes outer teeth 852*a* and a central main gear passage 851 that has a select shape. In this embodiment, the select shape is a hexagon. The brake assembly 861 further includes a center rotor 854. Coupled to the center rotor 854 are rotor teeth 854*a* that are designed and position to engage the outer teeth 852*a* of the main gear 852. The center rotor 854 is mounted within the first housing portion 841*a* and the second housing portion 841*b* via router shaft 862. The router shaft 862 is received in respective housing seats in the first housing portion 841*a* and the second housing portion 841*b*. Further, rotor shaft bearings 860*a* and 860*b* are positioned within the respecting housing seats to engage respective ends of the rotor shaft 862. Pivotally coupled to the oppositely extending arms of the center rotor 854 is a pair of braking pawls 856*a* and 856*b*. Brake pads 857*a* and 857*b* are coupled to the respective braking pawls 856*a* and 856*b*. The braking pads 857*a* and 857*b* engage a braking chamber 837 that is formed in the first housing portion 841*a* of the personal descent system 900.

Figure 14:
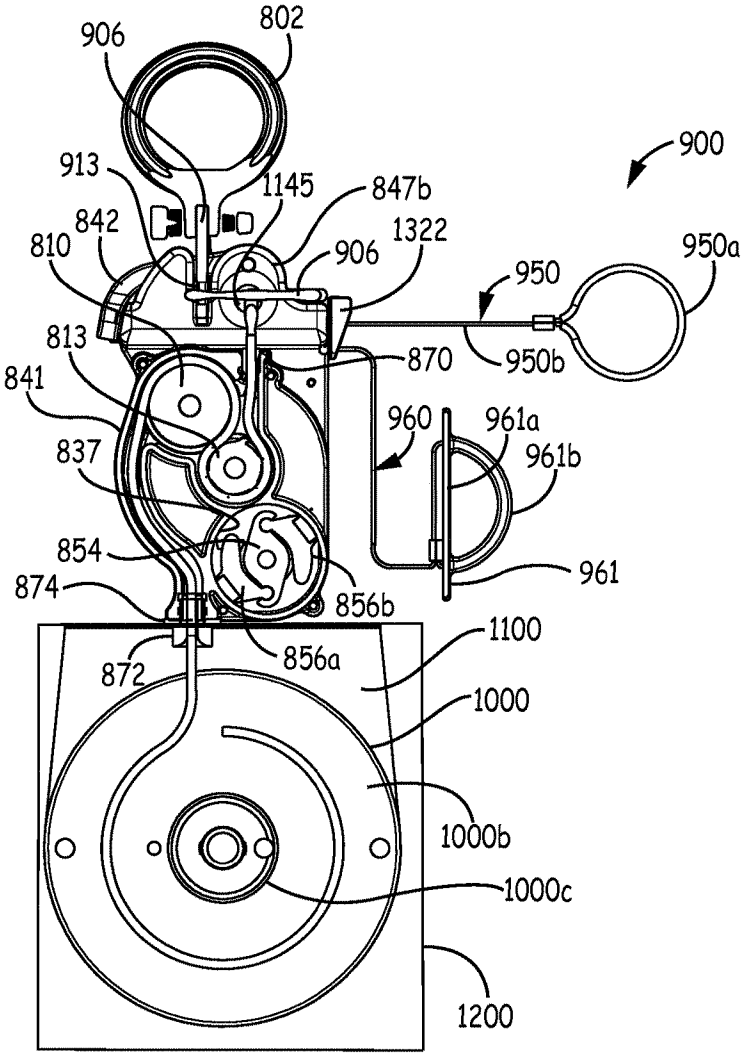
FIG. 14 is a partial front view of the personal descent system of FIG. 10.

The brake assembly 861 further includes a brake pulley 812. The brake pulley 812 includes a gear engaging portion 812*a* that is designed to be received in the central main gear passage 851 of the main gear 852. The brake pulley 812 further includes a central passage 813 through which a pulley shaft 814 rotationally couples the brake pulley 812 and the main gear 852 to the first housing portion 841*a* and the second housing portion 841*b*. In particular, pulley shaft 814 is received in respective seats in the respective first housing portion 841*a* and the second housing portion 841*b*. In the embodiment shown, bearings 858*a* and 858*b* are received on respective ends of the pulley shaft 814. Rotationally coupled within the first housing portion 841*a* and the second housing portion 841*b* near the brake pulley 812 is a routing pulley 810. The descent lifeline 902 is routed around the routing pulley 810 and the brake pulley 812 as illustrated in FIG. 14.

Figure 13A:
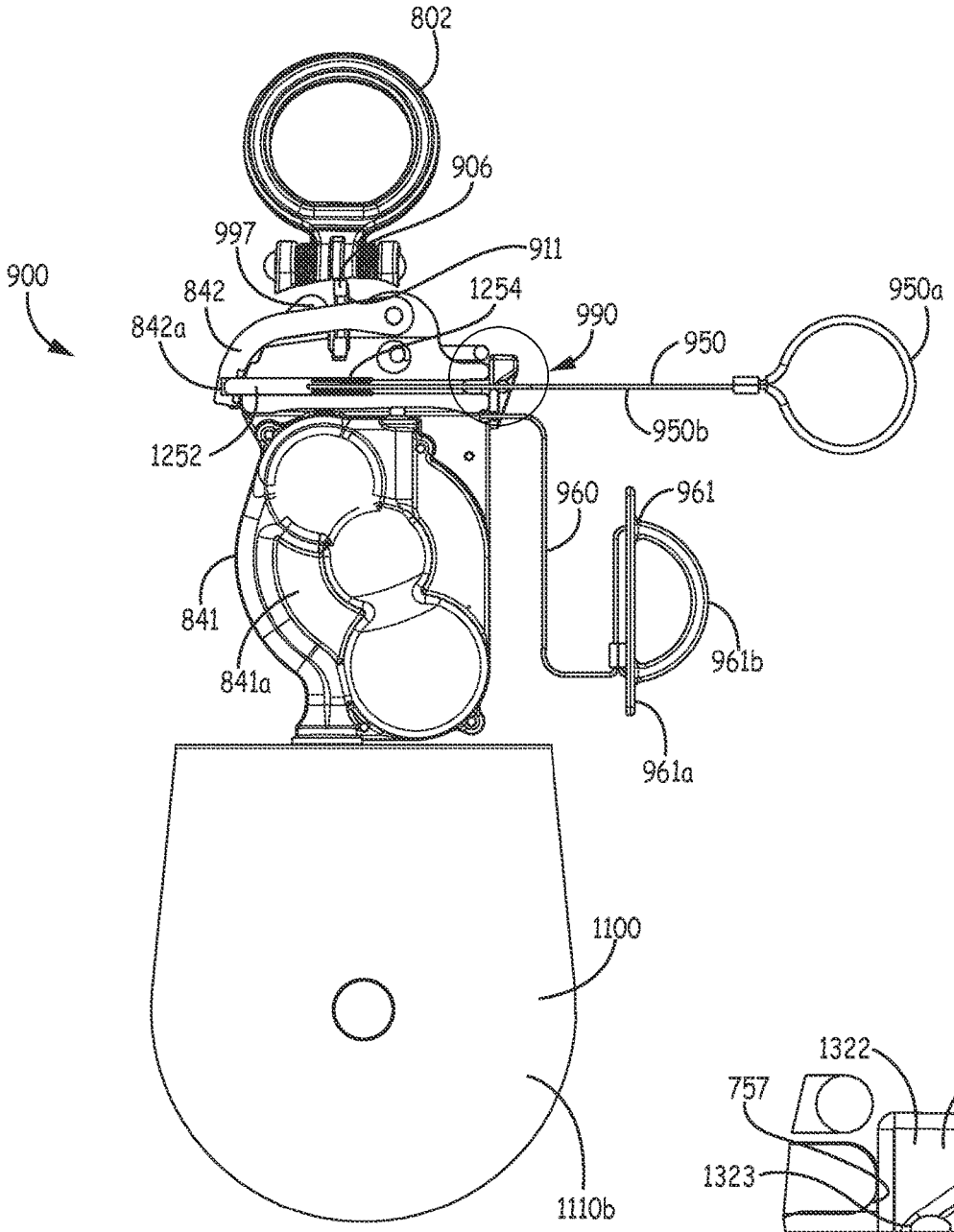
FIG. 13A is a partial front view of the personal descent system of FIG. 10.
Figure 13B:
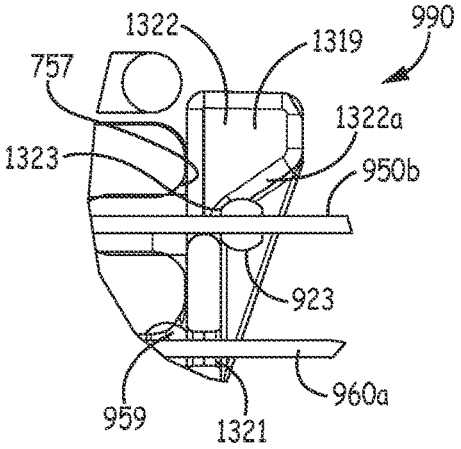
FIG. 13B is a close up view of a portion of FIG. 13A.

The descent lifeline 902 passes through a bottom portion of the first housing portion 841*a* via threaded entry passage generally designated as 845 in FIG. 11. A sealing bolt 872 having a central lifeline passage 872*a* is threadably engaged with the threaded entry passage 845 in the first housing portion 841*a* to couple the spool bracket 1100 to the first housing portion 841*a*. A sealing washer 874 is used to provide a sealed connection. The descent lifeline 902 passes through the central lifeline passage 872*a* of the sealing bolt 872 as best illustrated in FIG. 14. In an embodiment, a sealing container 1200 such as poly bag surrounds the spool 1000 and the spool bracket 1100 (illustrated below in FIG. 14). The sealing bolt 872 positioned around the descent lifeline 902, is first routed through the spool bracket 1100 and then through a hole in the poly bag 1200. The sealing washer 874 is then placed in position and the threads of the sealing bolt 872 are engaged with threads in passage 845. This configuration provides a sealed connection between the spool 1000 of descent lifeline 902 and the brake assembly 861 in the housing 841 discussed below. The descent lifeline 902 further passes through an exit passage 843 of the first housing portion 841*a*. In one embodiment, a breakaway seal 870 is used to prevent debris and moisture from entering the housing 841. The personal descent system 900 in this embodiment also includes and first deployment seal 752 and a second deployment seal 754. The first deployment seal 752 is positioned around a lock pin 1252 of the self-deployment system 950 as shown in FIG. 13A and the second deployment seal 754 is positioned in the deployment passage 740 proximate the a conical mouth 757 of the housing 841 as shown in FIGS. 13A and 13B. These deployment seals 752 and 754 prevent debris and moisture from getting within the housing 841.

As illustrated in FIG. 11, the spool bracket 1100 includes a central mid-plate 1110*a* with opposably extending side plates 1110*b* and 1110*c* that generally form a U-shape. The mid-plate 1110*a* includes a lifeline passage 1111*c* through which the descent lifeline 902 extends through. Each of the extending side plates 1110*b* and 1110*c* includes a mounting aperture 1111*a* and 1111*b* (shown in FIG. 15). Spool bearings 1020*a* and 1020*b* passing through the respective mounting apertures 1111*a* and 1111*b* rotationally couple the spool 1000 to the spool bracket 1100. The spool 1000 includes a central hub 1000*c* and opposably mounted first and second disks 1000*a* and 1000*b*. The central hub 1000*c* includes a central spool passage 1001 in which the respective spool bearings 1020*a* and 1020*b* are received.

A latch arm 842 is coupled to the second housing portion 841*b* of the housing 841 via pivot connection 844 that passes through descent connecting arms 847*a* and 847*b* similar to personal descent system 200 discussed above. The personal descent system 900 of this embodiment further includes a self-deployment system 950 including an elongated portion 950*b* (self elongated portion) and an end looped portion 250*a* to allow a user to grasp the self-deployment system 950. This is similar to deployment system 250 discussed above. Moreover, similar to personal descent system 200 discussed above, personal descent system 900 employs a stop 923 on the elongated portion 950*b* and buddy activating base member 1322. In this embodiment, a buddy deployment system 960 includes an elongated portion 960*a* (elongate buddy portion) that has one end coupled to the buddy activating base member 1322 and the other end coupled to a buddy activation portion 961. The buddy activation portion 961 includes an activation base 961*a* and an activation connection portion 961*b* which are further discussed below.

FIG. 11 further illustrates a ratchet arm 762 and a pin 764. The ratchet arm 762 is held in place by a pocket (not shown) formed by the first housing portion 841*a* and the second housing portion 841*b*. The ratchet arm 762 engages the outer teeth 852*a* of the main gear 852. Initially during assembly, although the ratchet arm 762 engages the outer teeth 852*a* of the main gear 852, the configuration of the ratchet arm 762 and the pocket that holds ratchet arm 762 allows the main gear 852 to rotate in both directions. This allows the builders of the personal descent system 900 to properly position the descent lifeline 902 in relation to the spool 1000 and housing 841. Once, the descent lifeline 902 is properly position, the pin 764 is installed through a pin aperture 761 in the second housing portion 841*b*. The pin 764, once installed, engages the ratchet arm 762 in such a manner that the ratchet arm prevents the main gear 852 from rotation in a direction that winds the descent lifeline 902 back up on the spool 1000 after a deployment. This feature prevents the personal descent system 900 from being used more than one time.

Figure 12B:
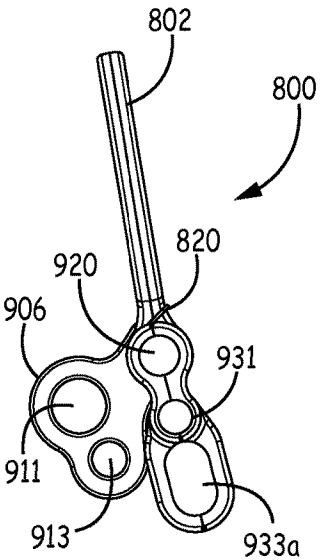
FIG. 12B is a side view of the support structure coupling assembly of FIG. 12A.
Figure 12A:
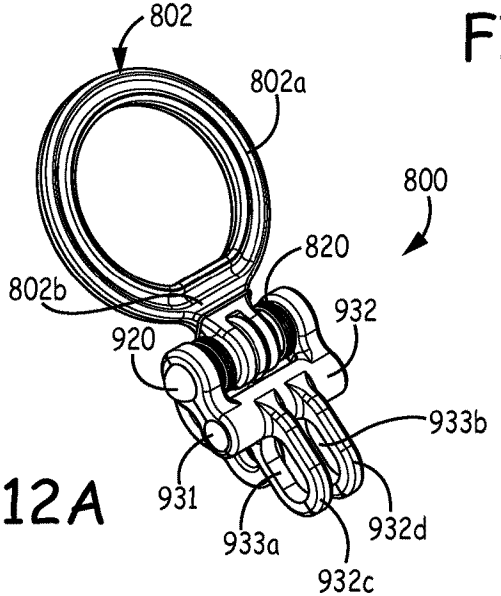
FIG. 12A is side perspective view of a support structure coupling assembly of one embodiment of the present invention.
Figure 12C:
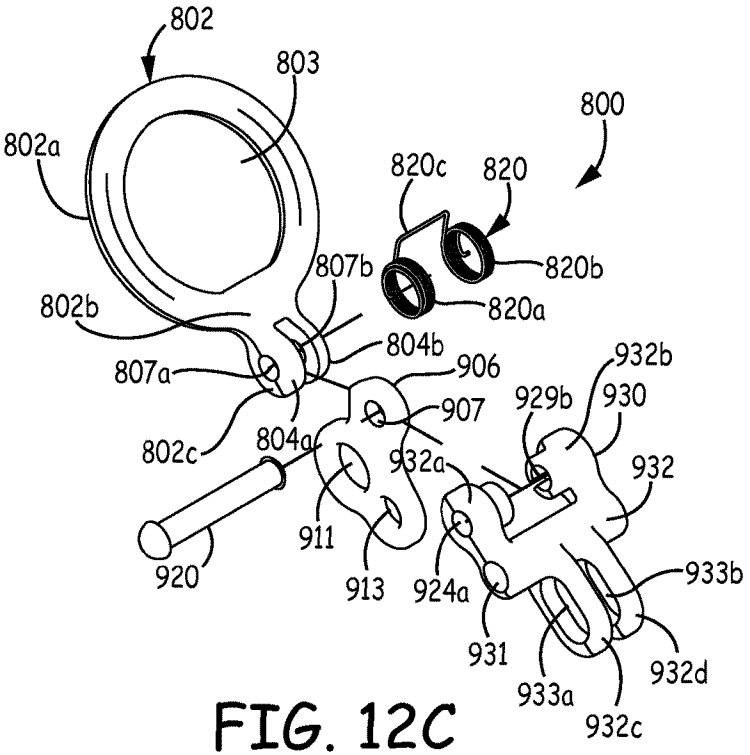
FIG. 12C is a side perspective unassembled view of the support structure coupling assembly of FIG. 12A.

The support structure coupling assembly 800 is further illustrated in detail in FIGS. 12A through 12C. The support structure coupling assembly 800 includes a D-ring 802. The D-ring 802 has a rescue portion 802*a*, a neck portion 802*b* and a D-ring connection portion 802*c*. The rescue portion 802*a* includes a rescue aperture 803. The D-ring connection portion 802*c* includes spaced first and second arms 804*a* and 804*b*. The first and second arms 804*a* and 804*b* include respective aligned connecting apertures 807*a* and 807*b*. The support structure coupling assembly 800 further includes a biasing member 820. The biasing member 820 includes a first coil portion 820*a*, a second coil portion 820*b* and an engaging portion 820*c* that extends between the first coil portion 820*a* and the second coil portion 820*b*. The support structure coupling assembly 800 further includes a main connection member 906. The main connection member 906, in this embodiment, includes three spaced apertures. In particular, the main connection member 906 includes a latch arm mounting aperture 911, an adapter member aperture 907 and a descent lifeline termination aperture 913. The latch arm mounting aperture 911 selectively receives the latch arm 842 of the personal descent system 900 to selectively couple the support structure coupling assembly 800 to the housing 841. One feature of this design is that the latch arm 842 is free to rotate within the latch arm mounting aperture 911. Hence, if a fall event occurs, the support structure coupling assembly 800 is allowed to move (i.e. rotate) in relation to the housing 841 due to the sudden load. The descent lifeline termination aperture 913 is used to couple the descent lifeline 902 to the main connector member 906. The support structure coupling assembly 800 further includes an adapter connection member 930. The adapter connection member 930, in this embodiment, includes a base portion 932 having a central connection member passage 931. Extending from one side of the base portion 932 are spaced D-ring connector arms 932*a* and 932*b* having aligned D-ring connection apertures 929*a* and 929*b*. Extending from an opposite side of the base portion 932 are spaced device connecting arms 932*c* and 932*d*. The spaced device connecting arms 932*c* and 932*d* include respective aligned device connecting apertures 933*a* and 933*b*. A D-ring rivet 920 passing through the D-ring connection apertures 929*a* and 929*b* of the adapter connection member 930, the connecting apertures 807*a* and 807*b* of the D-ring 802 and the adapter member aperture 907 of the main connector member 906 couple the D-ring 802, the main connection member 906 and the adapter connection member 930 together. Further, the coil portions 820*a* and 820*b* of the biasing member 820 are received around the D-ring rivet 920 in such a manner that the engaging portion 820*c* of the biasing member 820 engages the neck portion 802*b* of the D-ring 802. This configuration biases the D-ring 802 to a desired position.

Referring to FIG. 13A, a partial front view of the personal descent system is illustrated. In this view a portion of the second housing portion is removed to illustrate some of the internal components. In particular, FIG. 13A illustrates a lock pin 1252 that is coupled to the elongated portion 950*b* of the self-deployment system 950 (which can be generally referred to as the deployment system 950). As illustrated a portion of both the elongated portion 950*b* and the lock pin 1252 are received in the deployment passage 740 of the housing 841. The lock pin 1252 is further selectively received in a lock aperture 842*a* of the latch arm 842 to lock the latch arm 842 in a static position in relation to the housing 841. A lock biasing member 1254 received around a portion of the elongated portion 950*b* within the deployment passage 740 is positioned to assert a biasing force on the lock pin 1252 to bias at least a portion of the lock pin 1252 within the lock aperture 842*a*. In activating the personal descent device 900 the elongated portion 950*b* (self elongated portion) is pulled in a direction to counter the bias force of the lock biasing member 1254 therein allowing the portion of the lock pin 1252 to be removed from the lock aperture 842*a* of the latch arm 842. Also illustrated in FIG. 13A is a fuse 997 that is similar to fuse 150 discussed above. With this configuration, even if the self-deployment system 950 or the buddy deployment system 960 is pulled and the lock pin 1252 is removed from the lock aperture 842*a* of the latch arm 842, the personal descent device 900 will not be activated unless a select amount of force by the latch arm 842 is asserted on the fuse 997 to break the fuse 997 which in turn allows the latch arm 842 to pivot. This prevents the un-intentional activation of the personal descent device 900. The select amount of force is related to the amount of force the latch arm 842 provides when the personal descent device 900 is subjected to the weight of a user who is suspended after a fall.

A close up view of area 990 is illustrated in FIG. 13B. Here again, a portion of the components are removed to illustrate how the device is constructed. The buddy activation base member 1322 is constructed similar to the buddy activation base member 322 discussed above. During normal operations, the stop 923 is at rest in a seat 1323 of the buddy activation base member 1322. In this embodiment, the buddy elongated portion 960*a* of the buddy deployment system 960 extends through a buddy connection passage 1321 in the buddy activation base member 1322. A buddy stop 959 coupled at a terminal end of the buddy elongated portion 960*a* connects the buddy deployment system 960 to the buddy activation base member 1322. When the buddy deployment system 960 is used to activate the personal descent device 900, the movement of the buddy elongated portion 960*a* causes the stop 923 (self stop) of the self-deployment system 950 to ride up ramp section 1322*a* of the buddy activation base member 1322. This action counters the bias force of the lock biasing member 1254 therein allowing the portion of the lock pin 1252 to be removed from the lock aperture 842*a* of the latch arm 842. A slot 1319 in the buddy activation base member 1322 allows the elongated portion 950*b* of the self-deployment system 950 to become detached from the buddy activation base member 1322 once the personal descent device 900 has been activated. This configuration prevents the buddy deployment system 960 from interfering with the personal descent device 900 as payout of the descent lifeline 902 occurs during a rescue descent. It also prevents a rescue hook and pole arrangement, used to engage the buddy deployment system 960, from being pulled out of the rescuer's hands during deployment of the personal descent device 900. This embodiment also includes a conical mouth 757, similar to conical mouth 257 discussed above.

Figure 15:
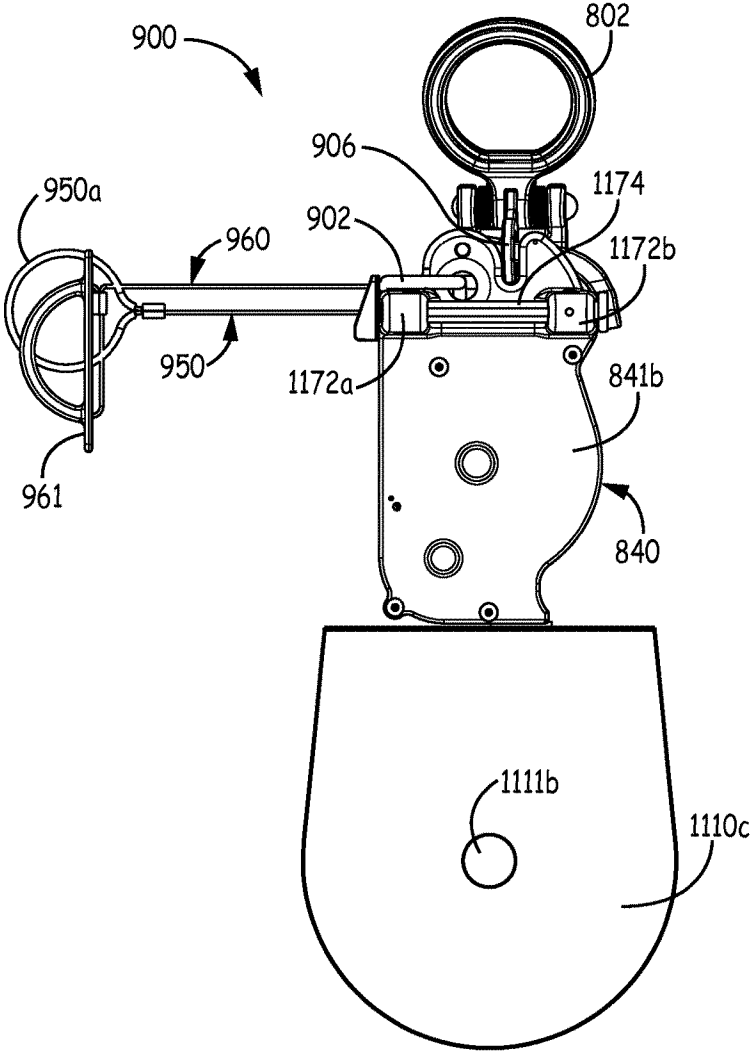
FIG. 15 is a back view of the personal descent system of FIG. 10.

FIG. 14 illustrates another partial front view of the personal descent device 900 with portions of the components removed to further illustrate the personal descent device 900 construction. This view illustrates the routing of the descent lifeline 902. As illustrated, the descent lifeline 902 is wound around the spool 1000 that in this example embodiment is housed in a sealing container 1200, such as but not limited to, a poly bag covering. Further, the descent lifeline 902 could be flaked in a bag, held with web loops, vacuum sealed in a pack etc. The descent lifeline 902 is then routed into the housing 841. As illustrated, the descent lifeline 902 is routed around the routing pulley 810 and then the brake pulley 812. The descent lifeline 902 then leaves the housing 841 and is routed through a routing aperture 1145 in the connecting arms 847*a* and 847*b* (only 847*b* is illustrated in FIG. 14) of the housing 841 and then around the connecting arms 847*a* and 847*b* to the main connection member 906. FIG. 14 also illustrates the seals that protect the brake assembly 861 within the housing 841. In particular, FIG. 14 illustrates sealing bolt 872 and sealing washer 874 coupling the spool bracket 1110 to the housing 841 as well as providing a passage into the housing 841 for the descent lifeline 902. The other seal at a passage within the housing is the breakaway seal 870. Breakaway seal 870 is pointed around the descent lifeline 902 where the descent lifeline 902 leaves the housing 841. The breakaway seal 870 is designed to break away from the housing 841 when the personal descent device 900 is activated. FIG. 15 illustrates a back view of the personal descent device 900. This view illustrates spaced harness connecting arms 1172*a* and 1172*b* that extend from the housing 841 and a housing connect pin 1174 that is coupled between the harness connecting arms 1172*a* and 1172*b*. In use, webbing from a safety harness (not shown) is routed between the housing connect pin 1174 and the housing 841 to couple the personal descent device 900 to the safety harness.

Figure 16B:
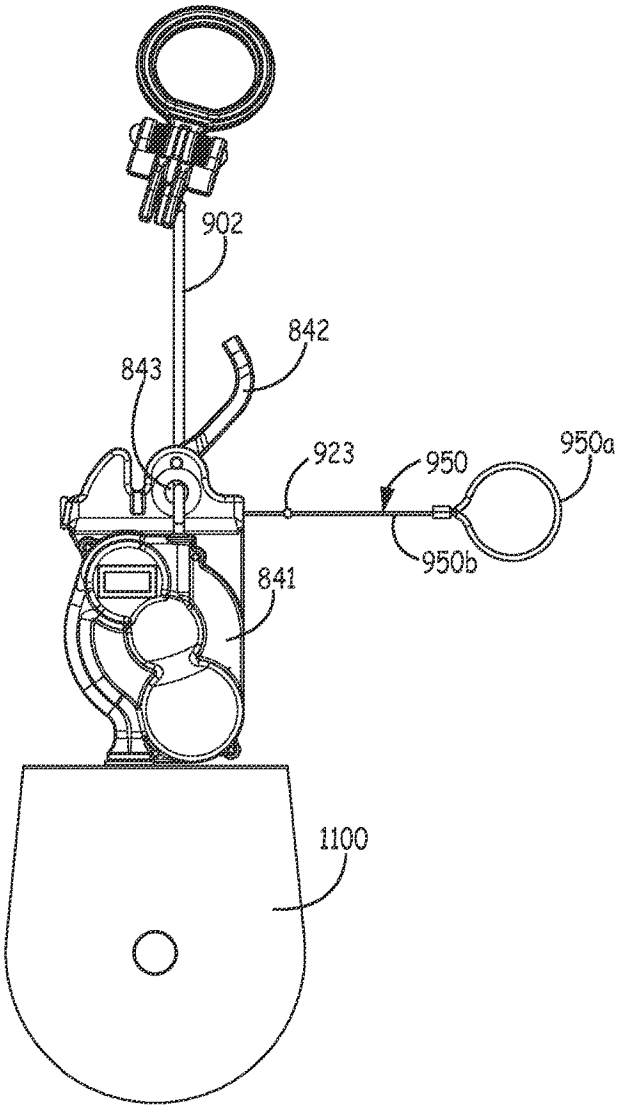
FIG. 16B is a front view of the personal descent system of FIG. 10 during activation at a second period of time.
Figure 16A:
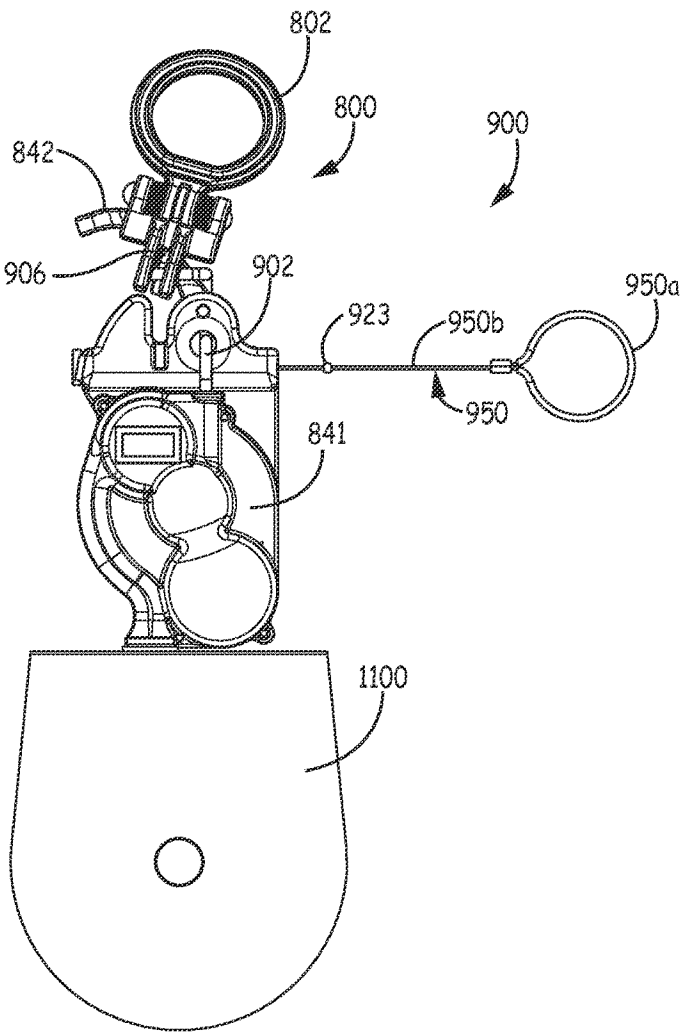
FIG. 16A is a front view of the personal descent system of FIG. 10 during activation at a first period of time.

FIGS. 16A and 16B illustrate the personal descent device 900 during different stages of an initial activation. In use, the personal descent device 900 is coupled to a safety harness donned by a worker as discussed above. A support structure lifeline (not shown) that coupled to a support structure is then coupled to the personal descent device 900. In one embodiment the lifeline is coupled to the D-ring 802 of the support structure coupling assembly 800. In another embodiment the support structure lifeline is coupled to the adaptor connection member 930 of the support structure coupling assembly 800. The support structure lifeline may be a self-retracting lifeline or any other type lifeline known in the art. In FIG. 16A, the self-deployment system 950 has been pulled which releases the lock pin 1252 from the lock aperture 842*a* of the latch arm 842 as discussed above. If a force by the latch arm 842 on the fuse 997 is great enough to break the fuse 997, as discussed above, the latch arm 842 pivots as illustrated in FIG. 16A. As the latch arm 842 pivots, it slides out of the latch arm mounting aperture 911 of the main connection member 906. As discussed above, the support structure coupling assembly 800 is coupled to a support structure lifeline (not shown). FIG. 16B illustrates the latch arm 842 clearing the latch arm mounting aperture 911 in the main connection member 906 allowing the support structure coupling assembly 800 to separate from the housing 841 which is coupled to the safety harness donned by a worker.

Figure 17:
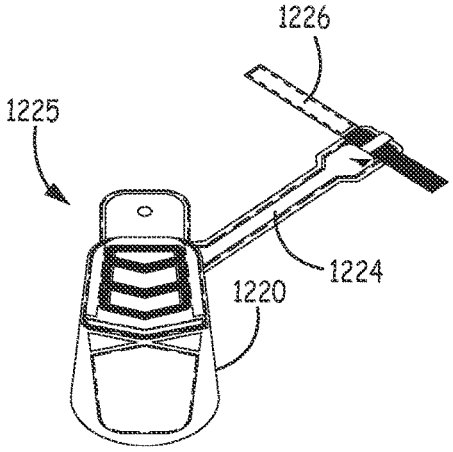
FIG. 17 is a front view of a containment system of one embodiment of the present invention.
Figure 18:
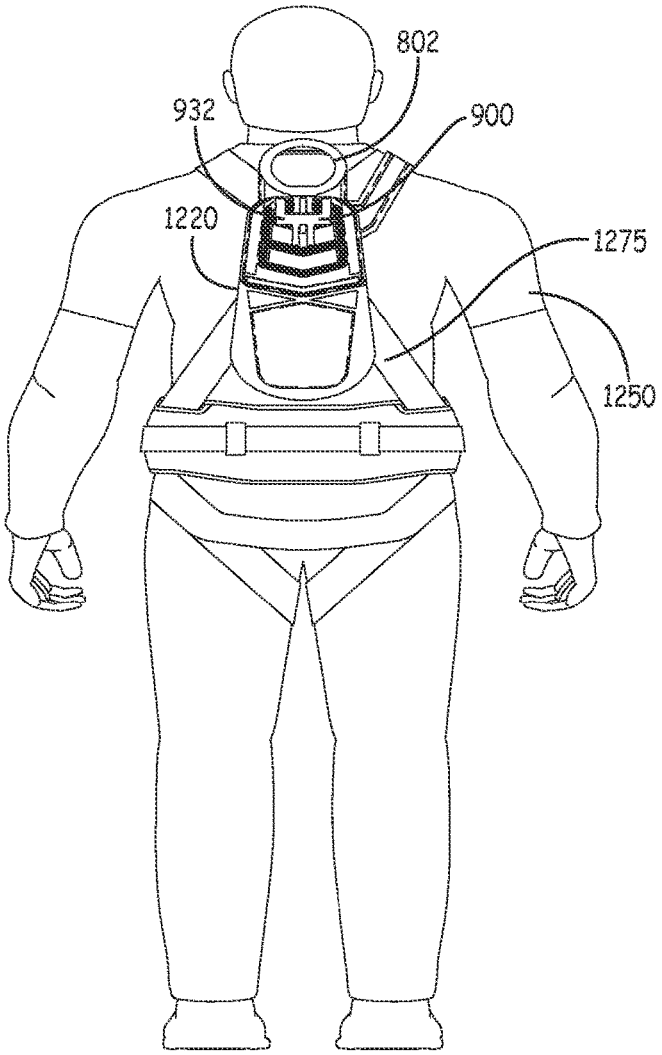
FIG. 18 is an illustration of the containment system of FIG. 17 coupled to a safety harness donned by a worker.

Referring to FIG. 17 an example of a containment system 1225 to house the personal descent system 900 as described above. The containment system 1225 includes a backpack 1220 (pouch) that is used to house at least a portion of the personal descent system 900. Extending from a side of the backpack 1220 is a self deployment sleeve 1224 that is designed to contain at least a portion of the self-deployment system 950. Attached proximate the end of the self deployment sleeve 1224 is a connection strap 1226 that is used to connect the self deployment sleeve 1224 to a webbing of the safety harness 1275 donned by the worker 1250. An illustration of the containment system 1225 used in conjunction with a personal descent system 900 attached to a safety harness 1275 donned by a worker 1250 is illustrated in FIG. 18. In one embodiment, the connection strap 1226 uses a connection system, such as but not limited to, a hook and loop arrangement to couple itself to the webbing of the safety harness 1275. The self deployment sleeve 1224 is positioned on the safety harness 1275 so the worker 1250 can reach the looped portion 950*a* of the self-deployment system 950.

Figure 19:
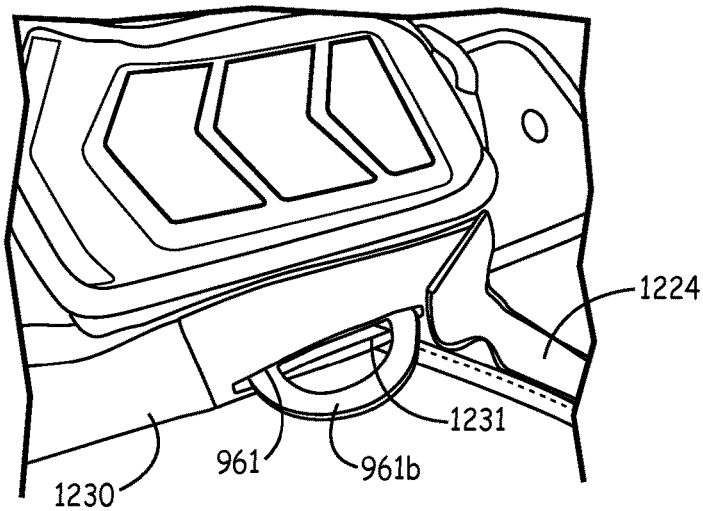
FIG. 19 is a partial side view of a containment system of another embodiment of the present invention.
Figure 20:
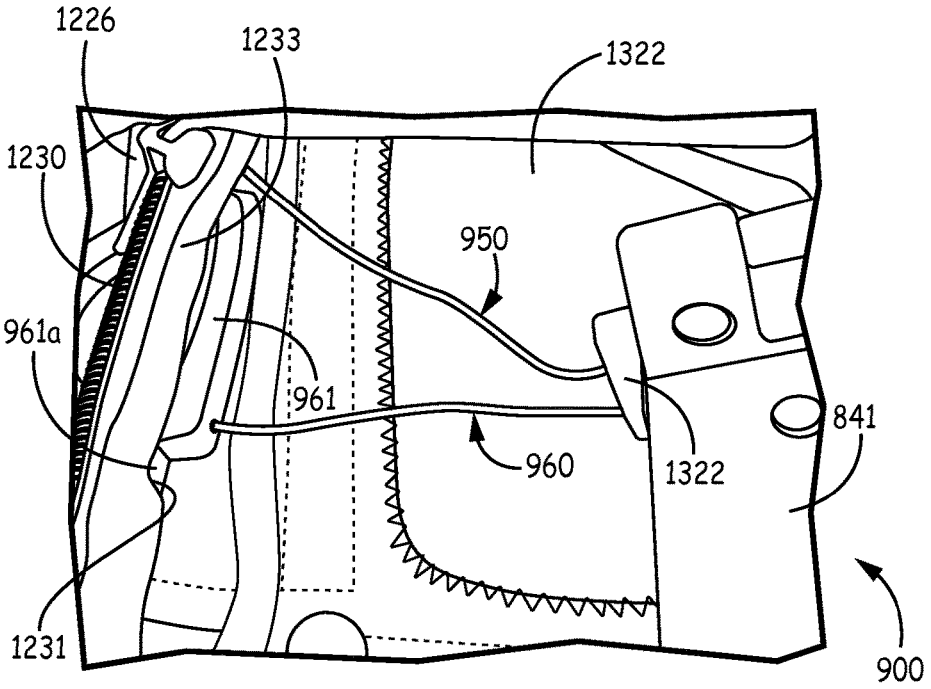
FIG. 20 is a partial view of an inside chamber of the containment system of FIG. 19.
Figure 21:
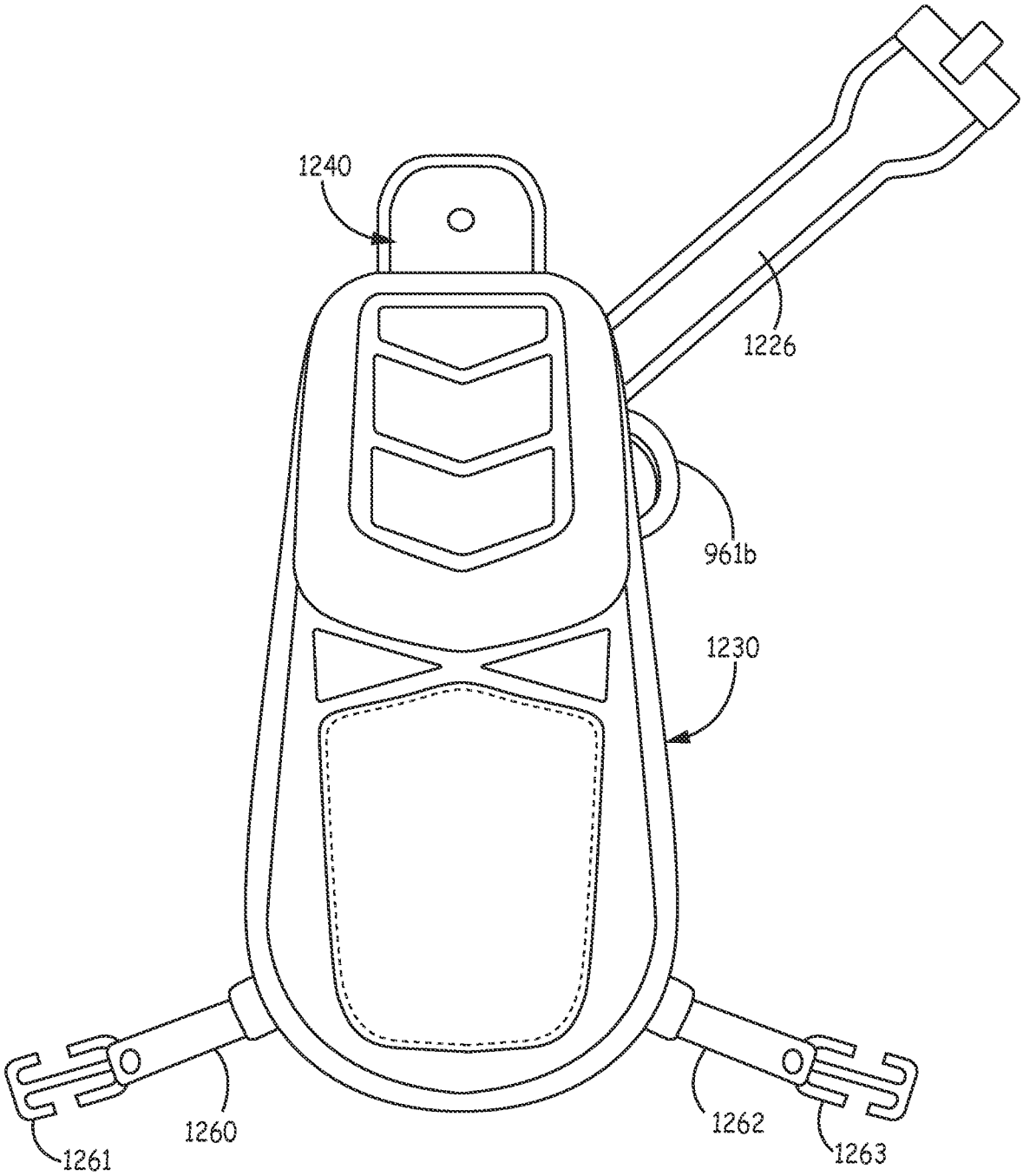
FIG. 21 is a front view of the containment system of FIG. 19.

An illustration of another embedment of a backpack 1230 of a containment system is shown in FIG. 19. In this embodiment, the backpack 1230 includes a side passage 1231 through which the activation connection portion 961*b* of the buddy deployment system 960 passes through. This allows access to the buddy deployment system 960 for a rescuer. Hence, a rescuer can activate the buddy deployment system 960 via grasping the activation connection portion 961*b* with a hook or the like. FIG. 20 illustrate a portion of an inside chamber of the backpack 1230 that houses at least a portion of the personal descent system 900. In particular, this illustration shows that a pocket 1233 is used to hold the activation base 961*a* of the buddy activation portion 961 in place. FIG. 21 further illustrates a front pocket cover 1240 of backpack 1230. The front pocket cover 1240 is used to cover an existing dorsal D-ring that would come with a harness. An example of an existing D-ring 1241 is illustrated in FIG. 8. The front pocket cover is used to prevent a user from accidentally hooking into the existing harness dorsal D-ring 1241 instead of D-ring 802 of the personal descent device 900. Also illustrated in FIG. 21 are bottom straps 1260 and 1262. The bottom straps 1260 and 1262 include respective buckles 1261 and 1263 that are coupled to webbing of the harness 1275. The bottom straps 1260 and 1262 control the bottom of the backpack 1230 on the webbing of the harness 1275.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A personal descent system comprising:

a support structure coupling assembly configured and arranged to be coupled to a descent lifeline, the support structure coupling assembly comprising a latch arm mounting aperture;

a control descent device comprising a pivotally coupled latch arm selectively coupled at a proximal end to the support structure coupling assembly through the latch arm mounting aperture, wherein the control descent device is configured and arranged to be coupled to a safety harness donned by a user, wherein the latch arm is selectively pivotable to a locked position in which the control descent device is secured to the support structure coupling assembly, and wherein the latch arm is selectively pivotable to an unlocked position in which the control descent device is detachable from the support structure coupling assembly during a descent operation while controlling a payout of the descent lifeline interconnecting the support structure coupling assembly and the control descent device, wherein the latch arm comprises a lock aperture at a distal end; and a lock pin slideably and removably received in the lock aperture of the latch arm to lock the latch arm in the locked position relative to the control descent device when the lock pin is positioned in the lock aperture and to release the latch arm so that it can pivot to the unlocked position when the lock pin is slideably removed from the lock aperture.

2. The personal descent system of claim 1, wherein the support structure coupling assembly further comprises a D-ring spaced from the latch arm mounting aperture, and a biasing member configured and arranged to bias the D-ring in a desired position in relation to the control descent device.

3. The personal descent system of claim 1, wherein the control descent device further comprises:

a brake assembly engaged with the descent lifeline to control a payout of the descent lifeline;

a housing, wherein the brake assembly is received within the housing, the housing having an entry passage for the descent lifeline to enter the housing and brake assembly and an exit passage to exit the housing; and a break away seal configured and arranged to seal the exit passage.

4. The personal descent system of claim 3, further comprising:

a sealing bolt having a central passage, the sealing bolt received in the entry passage of the housing, the descent lifeline passing through the central passage of the sealing bolt.

5. The personal descent system of claim 1, wherein the support structure coupling assembly further comprises:

an adaptor connection member configured and arranged to couple different types of lifelines and lanyards to the support structure coupling assembly;

a main connection member comprising an adapter member aperture configured to pivotally couple the adaptor connection member to the main connection member, the main connection member further comprising the latch arm mounting aperture and at least a descent lifeline termination aperture configured to couple an end of the descent lifeline to the support structure coupling assembly.

6. The personal descent system of claim 5, wherein the main connection member of the support structure coupling assembly engages the latch arm at a location on the latch arm that reduces a load on the lock pin that holds the latch arm in a static location in relation to the main connection member to ease activation of the control descent device.

7. The personal descent system of claim 5, further comprising:

a deployment system configured and arranged to selectively lock and unlock the latch arm to the control descent device to the main connection member, a portion of the deployment system positioned to be activated by the user of the safety harness.

8. The personal descent system of claim 5, further comprising:

a buddy deployment system configured and arranged to activate the deployment system by a rescue person.

9. The personal descent system of claim 8, further comprising:

the buddy deployment system configured to break away from the personal descent system after activation of the deployment system.

10. The personal descent system of claim 5, further comprising:

a fuse pin configured and arranged to keep the latch arm in the latch arm mounting aperture in the main connection member during non-fall events.

11. The personal descent system of claim 1, further comprising:

a spool to hold the descent lifeline; and a sealing container, the spool received within the sealing container.

12. The personal descent system of claim 1, further comprising:

the control descent device including a descent housing, the descent housing having a deployment passage and a conical mouth opening to the deployment passage; and a deployment system configured and arranged to deploy the control descent device to detach from the support structure coupling assembly during a descent operation, the deployment system including an elongated portion passing through the deployment passage in the descent housing, the deployment system configured and arranged to deploy the control descent device by pulling the elongated portion, the curvature of the conical mouth opening being configured to not impede the pulling of the elongated portion regardless which direction the elongated portion is being pulled.

13. A personal descent system comprising:

a descent lifeline;

a support structure coupling assembly including, a main connection member including a latch arm mounting aperture, the descent lifeline coupled to the main connection member, and a D-ring coupled to the main connection member; and a control descent device including, a housing including a deployment passage, the housing configured and arranged to be coupled to a safety harness donned by a user, a latch arm pivotally coupled at a proximal end to the housing, the latch arm selectively received within the latch arm mounting aperture of the main connection member to selectively couple the support structure coupling assembly to the control descent device, a brake assembly received within the housing, the brake assembly engaged with the descent lifeline to control a payout of the descent lifeline, and a self-deployment system including a self-elongated portion configured and arranged to selectively release the latch arm to allow the latch arm to pivot in relation to the housing therein causing the latch arm to be removed from the latch arm mounting aperture of the main connection member, a portion of the self-elongated portion being received within the deployment passage within the housing, a lock pin coupled to an end of the self-elongated portion, the lock pin slideably and removably received in a lock aperture at a distal end of the latch arm to lock the latch arm in a static position in relation to the housing when the lock pin is positioned in the lock aperture and to release the latch arm so that it can pivot when the lock pin is slideably removed from the lock aperture.

14. The personal descent system of claim 13, wherein the support structure coupling assembly further includes:

an adaptor connection member coupled to the main connection member, at least one of the D-ring and the adaptor connection member configured and arranged to couple a support lifeline to the support structure coupling assembly.

15. The personal descent system of claim 13, wherein the self-deployment system further comprises:

a biasing member received within the deploy passage of the housing, the biasing member positioned to assert a biasing force on the lock pin into the lock aperture of the latch arm.

16. The personal descent system of claim 15, further comprising:

a stop coupled to the self elongated portion;

a buddy activation base member including a seat, the stop received within the seat, the buddy activation base member further including a ramp surface; and a buddy elongated portion having a first end and a second end, the first end of the buddy elongated portion coupled to the buddy activation base member, the second end of the buddy elongated portion coupled to a buddy activation portion that is configured and arranged to be engaged by a rescue person.

17. The personal descent system of claim 16, further comprising:

a containment system to house the control descent device, the containment system having a slot, the containment system including a side passage in which a portion of the buddy activation portion extends through, the containment system further having a pocket to hold another portion of the buddy activation portion proximate the side passage.

18. A personal descent system comprising:

a descent lifeline;

a support structure coupling assembly including, a main connection member including a latch arm mounting aperture, the descent lifeline coupled to the main connection member, and an adaptor connection member coupled to the main connection member, the adaptor connection member configured and arranged to couple a support lifeline to the support structure coupling assembly;

a control descent device including, a housing, a pair of spaced descent connecting arms extending from the housing, the pair of spaced descent connection arms having aligned routing apertures, a latch arm pivotally coupled at a proximal end between the descent connection arms, the latch arm selectively received with the latch arm mounting aperture of the main connection member to selectively couple the support structure coupling assembly to the control descent device, wherein the latch arm comprises a lock aperture at a distal end, a lock pin selectively received in the lock aperture of the latch arm to selectively lock the latch arm in a static position relative to the housing, and a brake system contained within the housing, the brake assembly engaged with the descent lifeline to at least in part control a payout of the descent lifeline; and a spool to hold at least a portion of the descent lifeline, the descent lifeline routed from the spool into an entry to the housing, through the brake system in the housing, out an exit in the housing, through the aligned routing apertures in the descent connection arms to the main connector member.

19. The personal descent system of claim 18, further comprising:

a self-deployment system configured and arranged to selectively allow the latch arm to pivot in relation to the housing to detach the control descent device from the support structure coupling assembly; and a buddy deployment system configured and arranged to selectively allow the latch arm to pivot in relation to the housing to detach the control descent device from the support structure coupling assembly by a rescue person.

20. The personal descent system of claim 18, further comprising:

the housing having a deployment passage and a conical mouth opening to the deployment passage; and a self-deployment system configured and arranged to selectively allow the latch arm to pivot in relation to the housing to detach the control descent device from the support structure coupling assembly, the self-deployment system including a self elongated portion that passes through the deployment passage in the housing, a radius of a curvature of the conical mouth opening being configured to not impede a pulling of the self elongated portion regardless of a direction the self elongated portion is pulled.

21. The personal descent system of claim 18, further comprising:

a break away seal positioned near an exit of the housing; and a fuse positioned to prevent the latch arm from rotating in relation to the housing until a select amount of force is applied.

* * * * *